US005340983A

United States Patent [19]

Deinzer et al.

[11] Patent Number: 5,340,983

[45] Date of Patent: Aug. 23, 1994

[54] METHOD AND APPARATUS FOR MASS ANALYSIS USING SLOW MONOCHROMATIC ELECTRONS

[75] Inventors: Max L. Deinzer; James A. Laramée, both of Corvallis, Oreg.

[73] Assignee: The State of Oregon acting by and through the State Board of Higher Education on behalf of Oregon State University, Eugene, Oreg.

[21] Appl. No.: 884,705

[22] Filed: May 18, 1992

[51] Int. Cl.[5] ..... H01J 49/14

[52] U.S. Cl. ..... 250/281; 250/282; 250/288; 250/427

[58] Field of Search ..... 250/281, 282, 288, 427

[56] References Cited

U.S. PATENT DOCUMENTS

| | | | |
|---|---|---|---|
| 2,939,952 | 6/1969 | Paul et al. | 250/292 |
| 4,649,279 | 3/1987 | Delmore | 250/427 |
| 4,933,551 | 5/1990 | Bernius et al. | 250/288 |
| 5,015,848 | 5/1991 | Bomse et al. | 250/281 |

OTHER PUBLICATIONS

Roy, "Characteristics of the Trochoidal Monochromator by Calculation of Electron Energy Distribution," *Rev. Sci. Instrum.* 43:535–541 (1972).

Stamatovic and Schulz, "Dissociative Attachment in CO and Formation of C–," *J. Chem. Phys.* 53:2663–2667 (1970).

McMillan and Moore, "Optimization of the Trochoidal Electron Monochromator," *Rev. Sci. Instrum.* 51:944–950 (1980).

"Electronic 'Sniffer' for the Army," *New Scientist* (Jan. 24, 1985).

Bleakney and Hipple, "A New Mass Spectrometer with Improved Focusing Properties," *Phys. Rev.* 53:521–529 (1938).

Todd, "Ion Trap Mass Spectrometer–Past, Present, and Future (?)," *Mass Spectrometry Rev.* 10:3–52 (1991).

Paul, "Electromagnetic Traps for Charged and Neutral Particles," *Rev. Mod. Phys.* 62:531–540 (1990).

Cooks et al., "Ion Trap Mass Spectrometry," *Chemical & Eng. News* (Mar. 25, 1991).

Stamatovic and Schulz, "Characteristics of the Trochoidal Electron Monochromator," *Rev. Sci. Instrum.* 41:423–427 (1970).

Stamatovic and Schulz, "Trochoidal Electron Monochromator," *Rev. Sci. Instrum.* 39:1752–1753 (1968).

Kaiser et al., "Extending the Mass Range of the Quadrupole Ion Trap Using Axial Modulation," *Rapid Comm. in Mass Spect.* 3:225–229 (1989).

*Primary Examiner*—Jack I. Berman

*Attorney, Agent, or Firm*—Klarquist Sparkman Campbell Leigh & Whinston

[57] ABSTRACT

Methods and apparatuses are disclosed for mass-analysis of a sample for particular analytes of interest. An electron monochromator is coupled to any of a number of different types of mass analyzer and used to generate slow electrons used to produce ions of target molecules for mass analysis. The electrons have a narrow energy bandwidth and high intensity, even at nearly zero kinetic energy levels. The median energy level of the electrons can be preset, permitting selection of specific target molecules to be ionized. Both positive and negative-ion mass analysis can be performed. Electron-capture negative-ion mass spectrometry is particularly enhanced, with a sensitivity about three orders of magnitude greater than in results obtained using conventional negative-ion equipment. Also, a buffer gas is eliminated, allowing substantial reductions in negative-ion equipment size, weight, and energy consumption. The mass analyzer can be an ion trap, making possible sensitive analysis of low concentrations of chemical analytes, such as environmental contaminants, using a hand-held instrument. Multiple mass analyzers, or combinations of a mass analyzer with other analytical instruments such a gas chromatograph, can be coupled to the electron monochromator.

26 Claims, 10 Drawing Sheets (FIG. 2)

(WITH PRIOR ART SYSTEM)

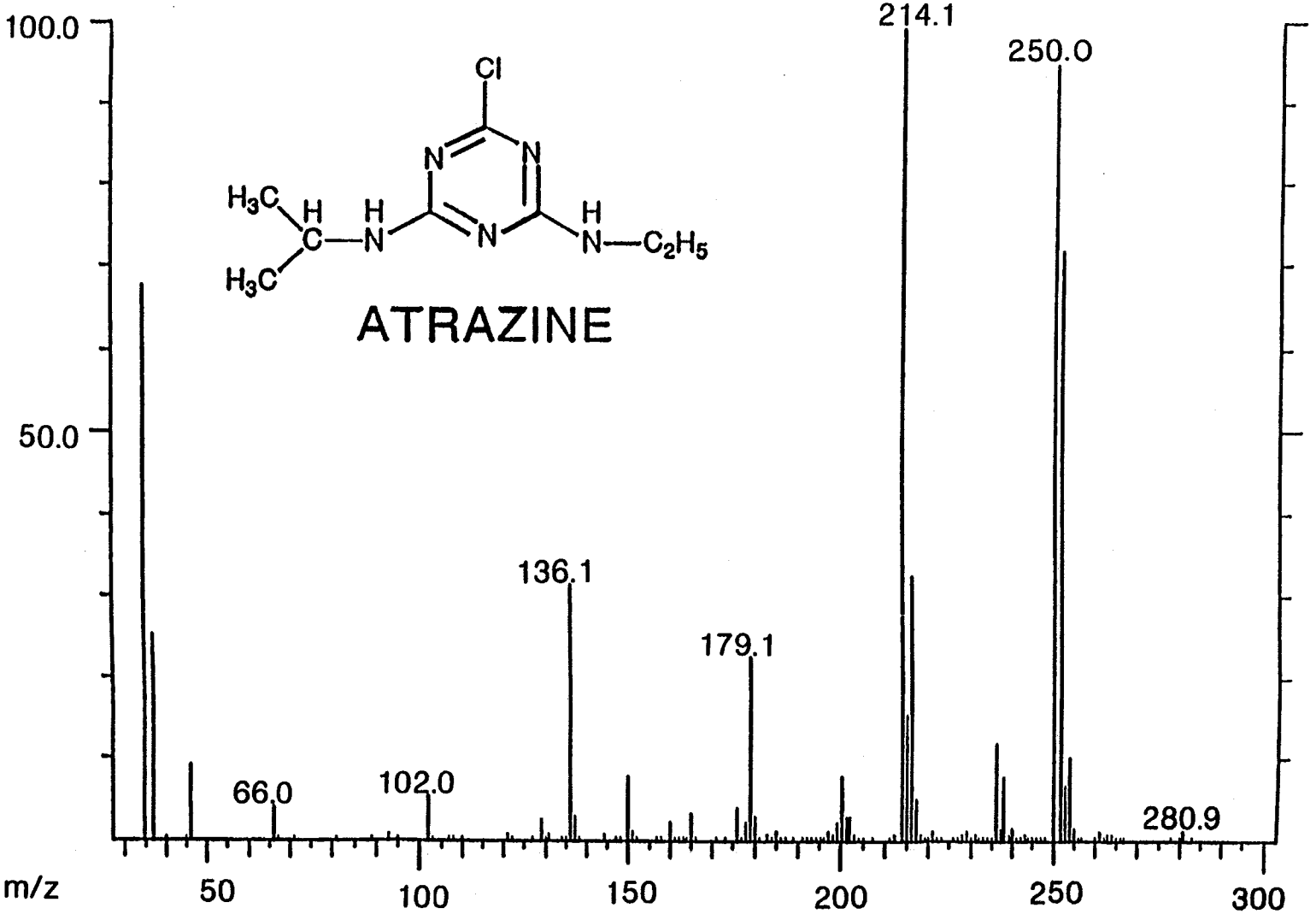
FIG. 8 (WITH PRIOR ART SYSTEM

ECNI MASS SPECTRUM WITH 1.81 eV ELECTRONS

ECNI MASS SPECTRUM WITH 0.03 eV ELECTRONS

METHOD AND APPARATUS FOR MASS ANALYSIS USING SLOW MONOCHROMATIC ELECTRONS

ACKNOWLEDGEMENT

This invention resulted from work performed under Grant No. ES 00040-28 from the National Institute of Environmental Health Sciences. The government has certain rights in this invention.

FIELD OF THE INVENTION

The present invention is directed to methods and apparatuses for ionic separation and analysis.

BACKGROUND OF THE INVENTION

Mass spectrometers have been known since the early experiments of J. J. Thomson who, with his "parabola" instrument, showed that a beam of ions having various masses and a range of energies can be mass-analyzed by passing them through uniform parallel magnetic and electric fields. These early experiments led to discoveries of previously unknown isotopes and to an increased understanding of ionization processes of atoms and molecules as well as various electron-mediated dissociation processes. As mass spectrometers have subsequently evolved, great increases have been made in the quality of these instruments, including in their resolving and detection powers.

Modern mass spectrometers are widely used for analysis of unknown mixtures of gases or liquids. They have also found wide applicability in detailed studies of chemical reaction mechanisms, such as analysis of free radicals and other reaction intermediates.

Since their debut, most mass spectrometers have employed at least one magnetic field for performing mass analysis. Such magnetic instruments are conventionally termed "sector" instruments.

Since the mid 1950s, mass analyzers employing only electric fields have been increasingly used, offering attractive features such as smaller size and lighter weight relative to the typically massive sector instruments. Electric-field instruments have exhibited a capability of scanning a range of masses at high repetitive rates, which has provided valuable data in studies of fast chemical reactions. Examples of such instruments include the "quadrupole mass filter" and the "ion trap".

A large amount of research using various types of mass spectrometers has been performed by analyzing positive ions produced by bombarding target molecules using "fast" electrons (i.e., electrons having a relatively high kinetic energy, greater than 10 to about 70 eV or higher). Briefly, according to conventional methods known in the art, the fast electrons are produced by a hot filament under high vacuum. The electrons are focused magnetically into a beam and urged into an "ionization chamber," also under high vacuum, containing molecules of the target material to be analyzed. Impingement of the fast electrons with molecules of the target material causes the target molecules to fracture into a number of positively charged molecular fragments having different m/z values. The positive ions are then drawn into the mass analyzer for analysis.

Positive-ion mass spectrometry (PIMS) using conventional methods and apparatuses has certain disadvantages. One disadvantage is that the positive ions (cations) are molecular fragments produced by fast electrons. Also, filaments of the type conventionally used with mass spectrometers produce electrons having a relatively broad range of individual kinetic energies (at least several electron volts). As a result, a number of differently sized cationic fragments of the molecules are formed. With a complex sample, the large number of cationic fragments that is generated produces a complex spectrograph that can be difficult to interpret.

Conventional mass spectrometers allow the operator to adjust the electron energy. (This is one way in which specificity can be enhanced because different compounds have different ionization energies and adjusting the electron energy can result in preferential ionization of a particular class of compounds relative to another class of compounds in a sample.) However, adjusting the electron energy in this manner does not result in a narrowing of the spectrum of electron energy produced by the filament; it merely results in a shifting up or down of the median energy of electrons produced by the filament. As a result, it is very difficult with such instruments to achieve truly energy-selective ionizations.

Conventional negative-ion mass spectrometry (NIMS) overcomes certain disadvantages of conventional PIMS. In NIMS, the ions that are mass-analyzed are anions, not cations. The anions are typically produced employing electrons having a lower kinetic energy (i.e., "slow" electrons which have energies of about 10 eV or less) than the electrons usually employed in conventional PIMS. Impingement of a slow electron with a target molecule can result in "capture" of the electron by the target molecule. Target molecules of many types of compounds remain intact as molecular anions after capturing electrons rather than breaking apart into cationic fragments, particularly if, for each such target molecule, the energy of the impinging electron is substantially equal to a resonance energy of the target molecule. Electrophilic target molecules are especially likely to undergo such resonant electron capture.

Another type of electron capture, termed "dissociative electron capture" results in a relatively limited splitting of the target molecule, such as the removal of one or more particular substituent groups, to produce at least one type of anionic fragment. Specifically which type of dissociation that occurs is dependent in part upon the energy of the impinging electron. (These technologies are conventionally termed "electron-capture negative-ion mass spectrometry" or ECNIMS.)

In conventional ECNIMS, the spectrograms are generally simpler than spectrograms in conventional PIMS. As a result, it can be easier in ECNIMS to discern the presence of a particular compound in the spectrogram. Thus, ECNIMS can allow identification of compounds present at low concentrations in complex mixtures that would be difficult to analyze using PIMS.

In conventional ECNIMS, the requisite "slow" electrons are generated by passing a beam of "fast" electrons produced by a hot filament into a "buffer" gas in an ionization chamber which also contains molecules of the sample to be mass-analyzed. As the fast electrons impinge upon molecules of the buffer gas, much of the kinetic energy of the electrons is dissipated. In order to achieve sufficient slowing of most of the electrons before they encounter molecules of the sample, a high molecular density of the buffer gas relative to the molecular density of the sample in the ionization chamber is required.

The following are representative reactions of the buffer gas with fast electrons (wherein "Bu" designates a molecule of the buffer gas and "M" designates a molecule of the target compound to be mass-analyzed):

$$Bu + e_{fast} \rightarrow Bu^{+\cdot} + e_{slow} + e_{fast}$$

$$e_{slow} + M \rightarrow M^{-\cdot}$$

Unfortunately, the presence of a large number of molecules of the buffer gas relative to the molecules of the target compound can result in reactions in which the negative ions of the sample compound ($M^{-\cdot}$) are reverted back to uncharged species before the negative ions can exit the ionization chamber and enter the mass analyzer:

$$Bu^{+\cdot} + M^{-\cdot} \rightarrow Bu + M$$

It is also possible for some of the fast electrons entering the ionization chamber to encounter molecules of the target compound before becoming sufficiently slowed, thereby producing undesirable positive ions. The presence of such neutral species and other spurious reaction products (including undesirable positive-ion products) can seriously degrade resolution and make the resulting mass spectrograms difficult to interpret.

Another disadvantage with conventional ECNIMS is that electrons tend to repel each other and the degree of such repulsion is more pronounced with slow electrons than with fast electrons. Such repulsion can cause substantial spreading of a beam of slow electrons, which can severely limit beam intensity. The lower the electron energy, the more pronounced the repulsion, which can unacceptably limit sensitivity and resolving power of a NIMS instrument.

In addition, the high buffer-gas pressure required in the ionization chamber is much too high for many types of mass analyzers. For example, with the conventional buffer gas methane ($CH_4$), the pressure in the ionization chamber must be about 0.5 to 1 Torr, compared to a typical "vacuum" of at least about $10^{-5}$ to $10^{-6}$ Torr that must be maintained in the downstream mass analyzer during actual use. As a result, conventional ECNIMS work requires that large-capacity (and therefore heavy and bulky) vacuum pumps be employed in order to achieve the requisite lowering of pressure in the mass analyzer, relative to the pressure in the ionization chamber, at the requisite rate. Such large pumping capacity has virtually prevented ECNIMS from being used in locations other than in a laboratory where large, heavy vacuum pumps that consume large amounts of energy can be accommodated. Also, the buffer-gas pressures required to adequately slow electrons are incompatible with the vacuum and electrical requirements necessary to isolate 25 KeV at 1 MHz which are necessary for operation of an ion trap. In addition, conventional ECNIMS requires a supply of the buffer gas which is usually supplied from a cumbersome and potentially dangerous gas cylinder.

To meet modern demands of environmental monitoring, surveillance, and other sophisticated uses, it is often necessary for the analytical equipment to be used on-site, such as in the field or away from a laboratory. This is particularly important when the sampled materials cannot practicably be removed to a laboratory for analysis or the target compound is simply too evanescent to permit anything other than real-time monitoring. Although ECNIMS has a sensitivity to be of significant value in many such applications, its use is often precluded because of the current necessity to maintain such instruments in a laboratory setting.

Another disadvantage of conventional ECNIMS instruments is their general inability to produce reproducible mass spectral data. Buffer gases such as methane tend to produce polymeric materials under ECNIMS conditions that coat the ion source and require frequent cleaning.

Therefore, there is a need for ECNIMS methods and apparatuses that are not encumbered by large tanks and pumps and can be used in the field.

There is also a need for mass-analysis methods and apparatuses having increased resolving power over conventional mass-analysis methods and apparatuses.

There is also a need for methods and apparatuses capable of accurately detecting the presence in samples of analytes at extremely low concentrations as required in environmental monitoring, forensic analysis, drugs and explosives detection, and other applications requiring high detection sensitivity and accuracy.

There is also a need for such methods and apparatuses capable of distinguishing between isomers of a particular compound.

There is also a need for such methods and apparatuses that produce mass-analysis data that are easy to interpret.

There is also a need for ECNIMS apparatuses that require less frequent cleaning and generate more reproducible mass spectral data than conventional ECNIMS apparatuses.

SUMMARY OF THE INVENTION

The foregoing needs are met by the present invention which provides methods and apparatuses for analyzing a sample material for the presence of an analyte of interest. The methods and apparatuses of the present invention can also be used to study chemical reactions, to determine the structures of unknown compounds in a sample, to distinguish between isomers of a particular compound, and other uses demanding high accuracy and sensitivity of mass analysis.

The present invention is particularly adapted for performing negative-ion mass spectroscopy, including mass spectroscopy of anions produced by resonant and dissociative electron capture. The present invention is also adapted for use in performing high-resolution positive-ion mass spectrometry.

According to one aspect of the present invention, an electron monochromator is coupled to any of various mass-analyzers and used to generate slow electrons (electrons having a kinetic energy of about 10 eV or less) which, in turn, are used to produce ions of specific target molecules for analysis by the corresponding mass analyzer. The electrons produced by the electron monochromator are monochromatic: they have a very narrow bandwidth of kinetic energy about a particular energy setting. For example, a representative energy bandwidth is less than ±0.1 eV. In addition, the monochromatic electrons remain tightly focused in an intense beam, even at nearly zero kinetic energy, up to the moment the electrons encounter target-compound molecules. As a result, surprising improvements in the sensitivity of various types of mass analyzers have been achieved, including improvements in sensitivity of about three orders of magnitude, over conventional equipment.

The median energy level (within the range of greater than zero to about 10 eV) of the monochromatic electrons can be preset by the operator while maintaining an extremely narrow energy bandwidth of the electrons. This permits the operator to limit the generation of ions to specific target compound(s) rather than ionizing the entire sample. Thus, the mass spectrogram of a sample can be simplified relative to a mass spectrogram of the sample obtained using conventional equipment, thereby simplifying determinations of target-compound identity and concentration.

In addition, an apparatus according to the present invention, wherein an electron monochromator is used to produce slow electrons rather than using a buffer gas, decreases the required vacuum-pumping capacity and eliminates the need for a supply of buffer gas. As a result, apparatuses according to the present invention are more convenient for use in the field or in any situation where smaller size and lower energy consumption are advantageous.

A combination of an electron monochromator and mass analyzer according to the present invention is particularly advantageous for performing negative-ion mass spectrometry (NIMS) by resonant electron capture. This is because the electron monochromator allows an operator to preset the kinetic energy of substantially all the electrons in the monochromatic beam to a level substantially below the energy required to fragment sample molecules into positive ions. As a result, the resulting mass spectrum is not obfuscated by spurious ionization and other products normally present in NIMS spectra obtained using conventional equipment.

Such a combination is also advantageous for NIMS of anions produced by dissociative electron capture because the extremely narrow energy bandwidth of the monochromatic beam and precise tunability thereof enable an operator to perform selective ionizations of particular chemical compounds present in a sample. For example, molecules of a target compound can be exposed to monochromatic electrons that have an energy appropriate for removing only a certain substituent group from a particular location on specific target-compound molecules.

A combination of an electron monochromator and mass analyzer according to the present invention is also particularly advantageous for performing low-energy positive-ion mass spectrometry. The tunability of the monochromatic beam and the extremely narrow energy bandwidth permit the operator to control the types of ionizations that occur, thereby simplifying the complexity of the mass spectrum and improving sensititivity. For example, it is now possible to ionize aromatic compounds in a hydrocarbon mixture without ionizing aliphatic compounds in the mixture.

Thus, with a particular sample mixture, it is now possible to selectively ionize most if not all the molecules of a particular compound in a sample mixture (or even a particular isomer of a compound), relative to other compounds or isomers in the mixture. As a result, a correspondingly large proportion of the ions actually entering the mass analyzer are the ions of interest. The corresponding increases in sensitivity and resolution over conventional mass-analysis methods and apparatuses are readily appreciated.

BRIEF DESCRIPTION OF THE DRAWINGS

FIG. 8 is an electron-capture negative-ion mass spectrum of atrazine obtained using a prior-art mass spectrometer.

DETAILED DESCRIPTION

Electron Monochromator

An electron monochromator utilizes a magnetic field to confine low-energy electrons produced by a filament and utilizes crossed magnetic and electric fields to disperse electrons having different energies. A series of lenses collimates and focuses the energy-selected electrons to increase electron-beam intensity. The electron monochromator also has the advantage of being tunable to accurately produce electrons having just the right kinetic energy for ionizing specific chemical compounds or isomers.

The electron monochromator is also known as a "trochoidal electron monochromator" due to the trochoidal motion of electrons therethrough. Stamatovic and Schulz, *Rev. of Sci. Instrum.* 39:1752–1753 (1968). The electron monochromator was first described by Bleakney and Hipple, *Phys. Rev.* 53:521–529 (1938), which described the trochoidal motion of a charged particle such as an electron when passing through crossed electric and magnetic fields (when the motion of the particle is viewed from a direction perpendicular to the magnetic field). (In general, a "trochoid" is a curve generated by a point on the plane of a circle that is rolled on the plane.)

Figure 1:
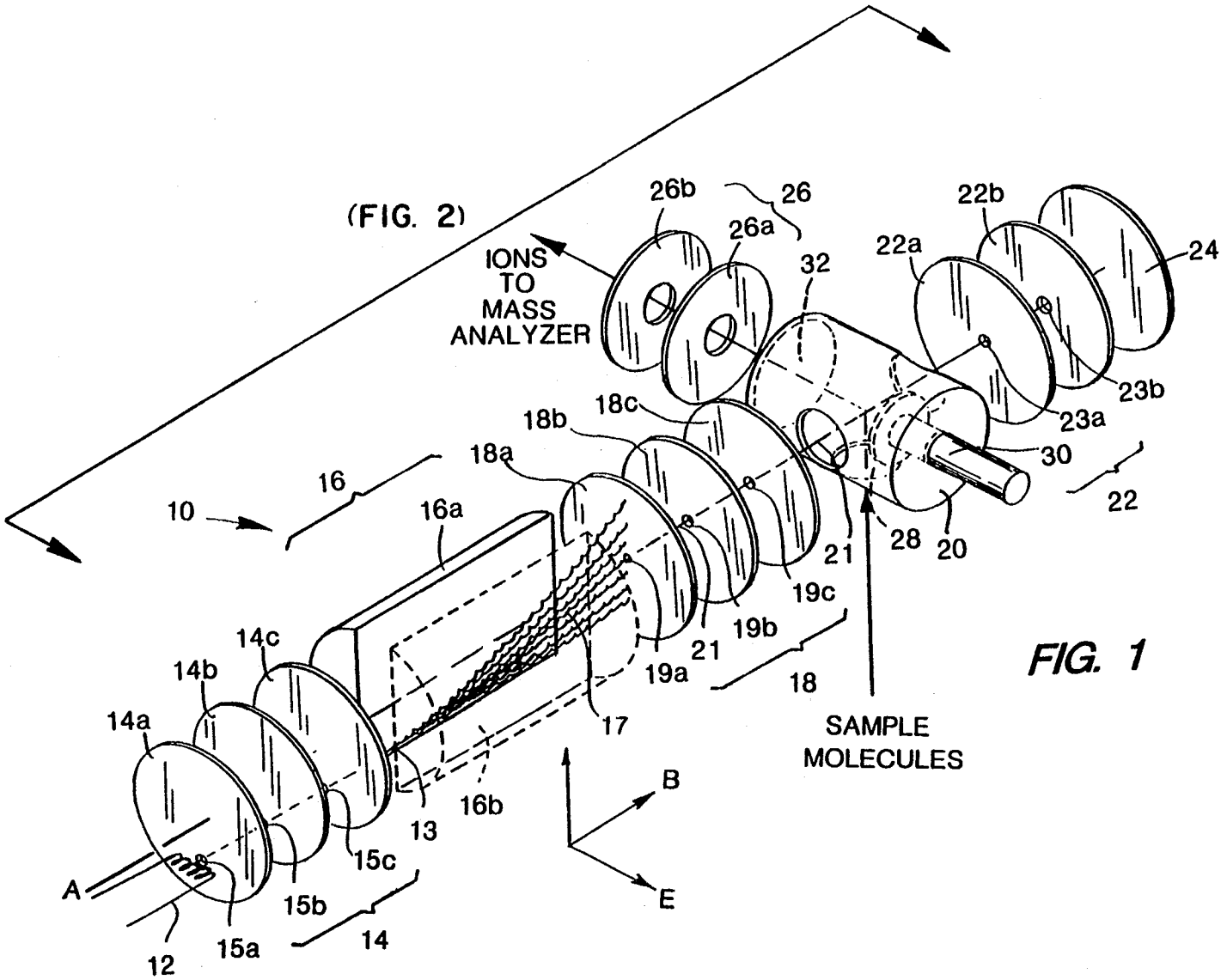
FIG. 1 is a conceptual isometric view of an electron monochromator showing the operating principle thereof.

An electron monochromator 10 is shown conceptually in FIG. 1, wherein is shown a filament 12, a first set 14 of electrode plates (also termed the "entrance electrode"), an electron-deflection region 16, a second set 18 of electrode plates (also termed the "exit electrode"), a reaction chamber 20, a third set 22 of electrode plates (also termed the "electron collector"), and an electron-target plate 24. The entrance electrode 14, deflection region 16, exit electrode 18, reaction chamber 20, electron collector 22, and target plate 24 are situated along a longitudinal axis A. Also shown are ion extraction optics 26 which are not actually part of the electron monochromator but serve to direct and focus negative ions produced by the electron monochromator 10 into a downstream mass analyzer. The components of the electron monochromator components shown in FIG. 1 are situated inside a housing (not shown) capable of withstanding a high internal vacuum. The housing can have any of a variety of configurations suitable for specific applications. (For clarity, the various electrode plates and other components shown in FIG. 1 are spaced further apart from one another than normal.)

During operation, the filament 12 is heated to glowing by passing an electric current therethrough, which causes the filament 12 to produce radiant electrons. The radiant electrons have a broad range of kinetic energies. The median kinetic energy of the electrons can be varied by adjusting the filament potential. For convenience, the filament potential is adjustable within a range of about zero to about −30 volts. However, to produce slow electrons for use according to the present invention, the filament potential is usually maintained between zero and −20 volts.

Slow electrons, particularly electrons having energies less than about 3 eV, have a strong propensity to individually move apart from one another. Such movement can seriously degrade resolution. Therefore, the electron monochromator requires some form of electron confinement means. Preferably, the electrons are confined in part by applying a magnetic field with a field vector B oriented along the axis A. Such a magnetic field can be created by any of various means, such as by employing a pair of coaxially aligned Helmholtz coils or permanent magnets (not shown) positioned outside of and surrounding the electron monochromator, and coaxial with the axis A.

Electrons produced by the filament 12 are also formed into a beam 13 by passage through the entrance electrode 14. The entrance electrode 14 is comprised of plural electrode plates **14*a*–14*c*, each of which carries an electrical charge. Each electrode plate 14*a*, 14*b*, 14*c* of the entrance electrode 14 defines an orifice 15*a*, 15*b*, 15*c*, respectively, through which the beam 13 passes. Thus, the entrance electrode functions as an "Einzel lens," as known in the art, and serves to maximize the intensity of the beam 13. The orifices 15*a*–15*c*** are laterally displaced from the longitudinal axis A.

To urge the electrons through the entrance electrode 14, the charges on the electrode plates **14*a*–14*c* are usually several volts more positive than the potential applied to the filament 12. Each plate 14*a*, 14*b*, 14*c*** is individually charged relative to the other plates.

After passing through the entrance electrode 14, the electron beam 13 enters the deflection region 16 comprised of two parallel opposing "dees" **16*a*, 16*b* (or analogous structures such as opposing parallel plates). (In FIG. 1, the dee 16*b* has been removed for clarity but its normal position is indicated by dashed line.) In the deflection region 16, the electrons in the beam 13** encounter not only the magnetic field B but also an electric field E at a right angle to the magnetic field. The electric field E is produced by applying a potential to each dee. The electric field between the dees is generated by applying a potential to one of the dees that is more negative than the potential applied to the other dee.

The crossed fields in the deflection region 16 cause the electrons to exhibit a trochoidal motion as they pass through the deflection region 16. In addition, because the beam 13 is comprised of a population of electrons collectively having a range of kinetic energies, passage of the electrons through the deflection region 16 causes the beam 13 to exhibit a divergent profile 17 perpendicular to the electric and magnetic fields. The amount of divergence D (upward in FIG. 1, as measured at the electrode plate 18a relative to the beam 13) experienced by an electron having kinetic energy $\gamma_0$ is expressed as:

$$D=(\gamma_d \cdot L)/\gamma_0,$$

where $\gamma_d=(E\times B)/B^2$ and L is the length of the dees **16*a*, 16*b***. As can be seen, the amount of divergence experienced by an electron is inversely proportional to the kinetic energy $\gamma_0$ of the electron.

The exit electrode 18 is comprised of multiple electrode plates **18*a*, 18*b*, 18*c*. Each of the electrode plates 18*a*–18*c* defines an orifice 19*a*, 19*b*, 19*c*, respectively, therethrough coaxial with the axis A. Thus, it will be appreciated that only those electrons in the beam 13 having a particular kinetic energy will experience sufficient deflection in the deflection region 16 to pass through the orifice 19*a*. Other electrons of the beam 13 having different kinetic energies will not have a trajectory passing through the orifice 19*a*. Thus, the deflection region 16 in combination with the exit electrode 18 produces a monochromatic beam 21 of electrons. The exit electrode 18 also functions to achieve maximum resolution of the monochromatic beam 21**.

The plates **18*a*–18*c* of the exit electrode individually have a potential that is generally more positive than the plates 14*a*–14*c*. For example, when the plates 14*a*–14*c* each have a potential of −1.3 V, −3.2 V, and −3.3 V, respectively, the plates 18*a*–18*c*** each have a potential of about −2.8 V, −2.2 V, and −1.5 V, respectively.

After passing through the exit electrode 18, the monochromatic beam 21 then enters the reaction chamber 20. The reaction chamber 20 is where the electrons in the monochromatic beam 21 encounter molecules of a target compound (also termed an "analyte") to form ions of the analyte. The analyte, which can be in a sample mixture containing multiple compounds, is introduced into the reaction chamber 20 through an orifice 28 such as by conventional injection methods.

Analyte ions that form in the reaction chamber 20 are urged to flow out of the reaction chamber in part by electrostatic repulsion. For this purpose, a repeller 30 is provided, bearing a slight negative potential for repelling anions or a positive potential for repelling cations. The repeller 30 preferably extends into the reaction chamber 20 from a direction opposite the direction in which the ions exit the reaction chamber. The repeller 30 is positionally adjustable to permit movement thereof toward or away from the monochromatic beam 21.

Any unreacted electrons in the monochromatic beam 21 exit the reaction chamber 20 through orifices 23*a*, 23*b* defined by the electrode plates 22*a*, 22*b*, respectively, of the electron collector 22. The electrons are collected by the target plate 24.

Analyte ions exit the reaction chamber 20 through an orifice 32. To further facilitate drawing out the ions, ion-extraction optics 26 are employed. The ion-extraction optics 26 typically comprise plural lenses 26*a*, 26*b* which are positively charged (i.e., have a positive "draw-out potential") to draw anions out of the reaction chamber 20 or negatively charged (i.e., have a negative draw-out potential) to draw cations out of the reaction chamber 20. (Although only two lenses 26*a*, 26*b* are shown in FIG. 1, more lenses can be provided, including some lenses bearing a neutral charge. The draw-out potentials can be made adjustable to depend upon mass values of the ions produced in the reaction chamber, wherein the larger the ionic mass, the higher the potential.)

The electron-optical components of the electron monochromator, i.e., the entrance electrode 14, the dees 16*a*, 16*b*, the exit electrode 18, the electron collector 22, the electron target plate 24, the reaction chamber 20, and the repeller 30 are preferably made from 99.999%-pure molybdenum to reduce undesirable surface phenomena. Non-magnetic stainless steel or other non-magnetic material capable of withstanding high vacuum can be used for the housing and for other components of the electron monochromator, as well as for the high-vacuum system used to evacuate the electron monochromator and downstream mass analyzer during operation.

Figure 2:
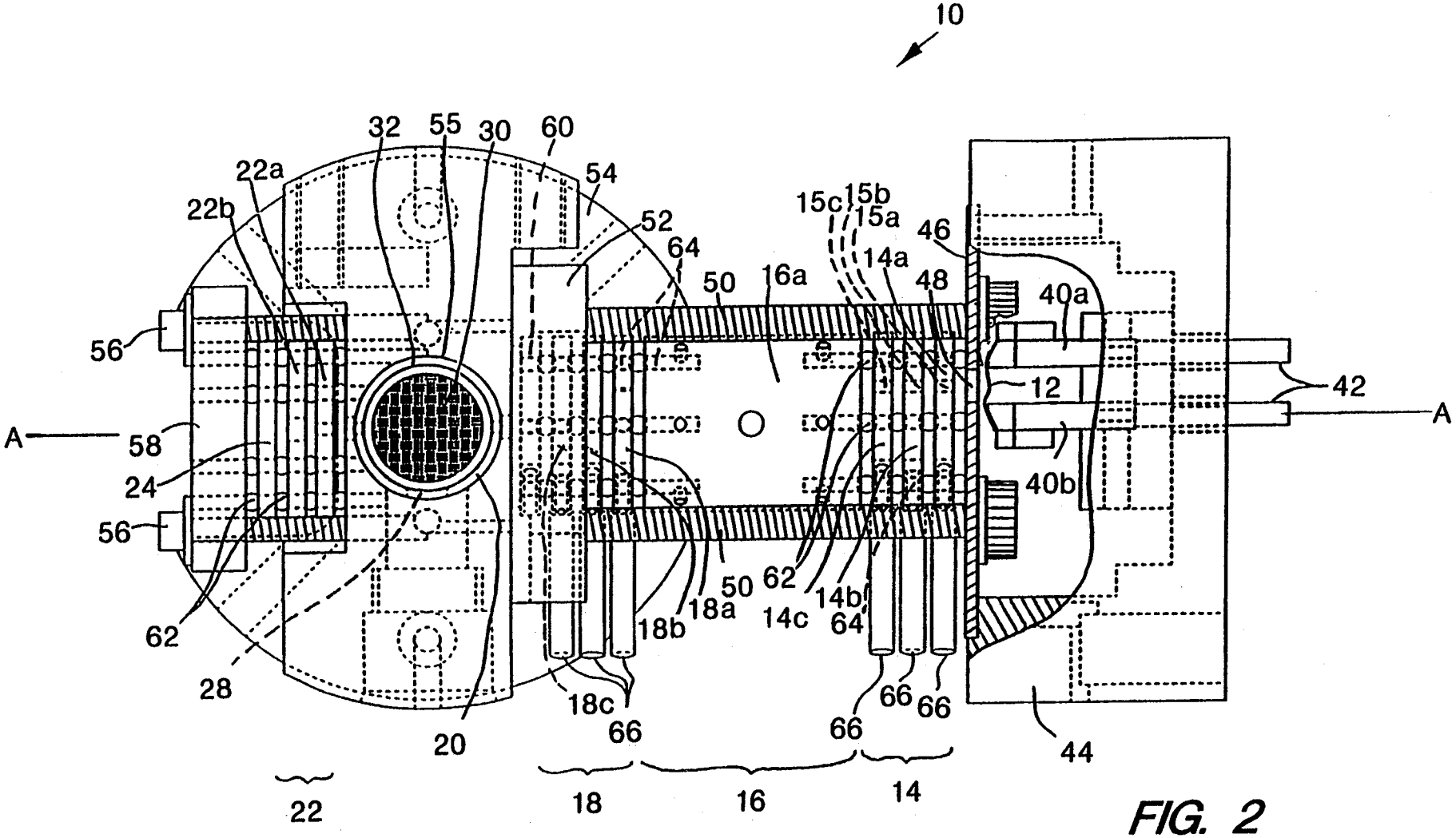
FIG. 2 is a side elevational view of one embodiment of an electron monochromator.

A representative embodiment of an electron monochromator 10 suitable for use according to the present invention is shown in FIG. 2, wherein components similar to those shown in FIG. 1 have the same reference designators. Thus, FIG. 2 shows the entrance electrode 14, the deflection region 16, the exit electrode 18, the reaction chamber 20, the electron collector 22, and the electron target plate 24.

The filament 12 is held by filament supports 40*a*, 40*b*, and is supplied with electrical power by leads 42. The filament 12 is typically enclosed within a filament mounting flange 44. A cover plate 46 rigidly attached to the filament mounting flange 44 defines an aperture 48 therethrough adjacent the filament 12. The cover plate 46 serves to anchor the electron monochromator assembly to the filament mounting flange 44 and to protect downstream components of the electron monochromator from debris that could be produced if the filament 12 should fail. The aperture 48 allows passage therethrough of electrons produced by the filament 12 to pass through the cover plate 46 into the entrance electrode 14.

The entrance electrode 14, dees 16*a*, 16*b*, and exit electrode 18 are held together by bolts 50 which extend through the cover plate 46 and screw into a mating sleeve 52. The mating sleeve 52, in turn, is mounted to a reaction-chamber housing 54. The electron collector 22 and electron target plate 24 are also mounted to the reaction-chamber housing 54 via bolts 56 and a rigid endplate 58. The reaction chamber 20 fits into an opening 55 in the reaction-chamber housing 54.

In the FIG. 2 embodiment, the entrance electrode 14 comprises electrode plates 14*a*, 14*b*, 14*c*. The exit electrode 18 comprises energized electrode plates 18*a*, 18*b*, 18*c*. An additional non-energized (i.e., grounded) plate 60 can also be provided adjacent the electrode plate 18*c* to serve as a fringe-field corrector. The electron collector 22 comprises plates 22*a*, 22*b* adjacent the electron target plate 24. In the FIG. 2 embodiment, each said plate 14*a*–14*c*, 18*a*–18*c*, 60, 22*a*–22*b*, 24 is circular, having a diameter of 15.9 mm (0.625 inch) and a thickness of 1.6 mm (0.0625 inch). The plates are arranged parallel to each other. Spacing between plates and between plates and dees is accurately defined by interposing spherical sapphire beads 62 (1.60-mm=0.063-inch diameter) therebetween to function as spacers and electrical insulators. (The sapphire beads are obtainable from General Ruby and Sapphire, New Port Richey, Fla.) Each sapphire bead 62 is captured in opposing bead-seating apertures 64 (1.20 mm=3/64 inch diameter) defined by the corresponding plates and dees. There are six sapphire beads 62 between each electrode plate (and between dees and adjacent plates) equiangularly spaced on a 0.5-inch diameter bolt circle.

The dees 16*a*, 16*b* define a space therebetween that is bilaterally symmetrical relative to the electrode axis A (FIG. 1). The width of the space is 3.2 mm (0.125 inch). The dees 16*a*, 16*b* have a length extending along said axis A of 19.1 mm (0.750 inch).

The cover plate 46 and plates 14*a*–14*c*, 18*a*–18*c*, 60, as well as the dees 16*a*, 16*b* (along with intervening sapphire beads 62) are arranged in the form of a stack held together by the bolts 50. Likewise, the plates 22*a*–22*b*, 24, (along with the endplate 58 and intervening sapphire beads 62) are arranged in the form of a stack held together by the bolts 56. The bolts 50, 56 are circumferentially arranged around the corresponding stack.

The filament-mounting flange 44, cover plate 46, and reaction-chamber housing 54 are preferably fabricated from 303 stainless steel. The filament supports 40*a*, 40*b* are preferably fabricated from oxygen-free high-conductivity copper.

The filament 12 can be constructed of any of several possible materials known in the art, including (but not limited to) rhenium, thoriated tungsten, and cerium hexaboride. Rhenium filaments are widely used for mass spectrometry but tend to run very hot, yielding electrons having a wide distribution of kinetic energies. Cerium hexaboride produces an intense beam of electrons having a narrow high-energy spread. In the FIG. 2 embodiment, the filament 12 is displaced laterally from the electrode axis A by 3.2 mm (0.125 inch) so that electrons produced by the filament 12 enter the electron deflection region 16 off-axis.

As discussed above, each of the electrode plates 14*a*–14*c* defines an aperture 15*a*–15*c*, respectively, for passage of electrons. The apertures 15*a*–15*c* are laterally offset from the electrode axis A by the same distance as the filament 12; that is, by 3.2 mm (0.125 inch). In the FIG. 2 embodiment, the apertures 15*a* and 15*b* have a diameter of 1.00 mm. The aperture 15*c* has a diameter of 0.50 mm.

Each of the electrode plates 18*a*–18*c* defines an aperture 19*a*–19*c*, respectively, for passage of electrons, as shown in FIG. 1. The apertures 19*a*–19*c* are coaxial with the electrode axis A. (In FIG. 2, the plate 60 also defines a coaxial aperture therethrough (not shown).) In the FIG. 2 embodiment, the aperture 19*a* is funnel-shaped (0.51 to 1.00 mm diameter) to prevent reflection of electrons from the aperture walls. The apertures 19*b*, 19*c*, as well as the aperture through the plate 60, have diameters of 1.0 mm.

Each of the collector plates 22*a*, 22*b* defines an aperture 23*a*, 23*b*, therethrough (FIG. 1) which are coaxial with the electrode axis A. In the FIG. 2 embodiment, the aperture 23*a* has a diameter of 1.0 mm and the aperture 23*b* has a diameter of 2.0 mm.

The electrode plates and dees are individually charged via a corresponding electrical lead 66. The leads 66 are energized by a multiple-channel power supply (not shown) wherein a separate channel is dedicated for each lead. Each channel "floats" the potential applied to the corresponding plate or dee relative to the potential of the filament 12. As discussed above, the plates 14*a*–14*c* of the entrance electrode are energized so as to achieve the greatest possible electron current (beam intensity) at the electron target plate 24. The plates 18*a*–18*c* of the exit electrode are energized so as to achieve maximum resolution of the monochromatic electron beam 21. The leads pass through the vacuum housing surrounding the electron monochromator via a high-vacuum multiple-pin feedthrough as known in the art (Ceramaseal, New Lebanon, N.Y.).

The FIG. 2 embodiment also shows the face of the repeller 30 visible through the orifice 32.

The electrons produced by the electron monochromator are monochromatic: that is, they have a very narrow bandwidth of kinetic energy about a particular energy setting. For example, a representative energy bandwidth is less than ±0.1 eV. However, the electron energy produced by the electron monochromator need not be limited to ±1 eV. The monochromator can be configured to produce a bandwidth as great as ±5 eV or any other bandwidth desired. However, bandwidths greater than about ±0.1 eV would not be considered "monochromatic". In any event, the monochromatic electrons remain tightly focused in an intense beam, even at nearly zero kinetic energy, up to the moment the electrons encounter target-compound molecules. This has resulted in surprising improvements in the sensitivity of mass analysis, including improvements of about three orders of magnitude over conventional mass-analysis methods.

Mass Analyzer

The mass analyzer to which the electron monochromator is coupled according to the present invention can be any of a number of types known in the art. These include (but are not necessarily limited to): ion trap, quadrupole mass filter (or other multiple-pole mass filter such as a dodecapole), quistor, high-resolution mass spectrometer, ion-mobility mass-spectrometer, ion-cyclotron resonance mass spectrometer, Fourier-transform ion-cyclotron resonance mass spectrometer, or molecular-beam apparatus. All these mass analyzers are capable to some extent of analyzing either negative or positive ions.

In addition to being used singly, mass analyzers such as those listed above (coupled to an electron monochromator) can be coupled to other analytical instruments such as a gas chromatograph. The electron monochromator can also be coupled to other devices that make use of electron beams and would derive a benefit from a source of monochromatic electrons, such as an electron microscope.

A quadrupole mass filter utilizes an electric field to perform mass analysis and is described in Paul et al., *Z. Physik* 152:143 (1958); Paul et al., U.S. Pat. No. 2,939,952 (1960). Quadrupole mass filters offer the ability to separate desired ions from a heterogeneous beam having a wide spread in velocity and direction of approach relative to the electric quadrupole field. A typical quadrupole mass filter utilizes two opposing pairs of longitudinally extended electrodes for a total of four electrodes. Although each electrode pair preferably has a transverse section shaped as a hyperbola, each electrode usually has a longitudinally cylindrical shape for economy of construction. The electrodes are parallel to each other and symmetrically arrayed around the longitudinal axis of the quadrupole (x-axis) so as to define a longitudinally extended space inside the array of electrodes. The pairs of electrodes are coupled together with radiofrequency (RF) and direct-current (dc) potentials applied between them. Ions generated by a source located at one end of the space enter the space. Depending upon the mass/charge ratio of individual ions, the amplitudes of the RF and dc potentials, the frequency of the RF drive potential, and the internal dimensions of the space, ions entering the space will have either "stable" trajectories and pass through the space along the x axis to a detector at the other end, or will have "unstable" trajectories and collide with one of the electrodes before passing through the space. A mass spectrum is obtained by sweeping the RF and dc potentials such that their amplitudes remain at a constant ratio, thereby allowing different ions to pass through the space at different points of the sweep profile.

Similar instruments with more "poles" are also known in the art, including "dodecapole" mass filters.

Ions travel through a quadrupole mass filter at a constant velocity in the x direction. Ion motions in the y and z directions are according to specific cases of the Matthieu differential equation. Ions travel through the quadrupole without hitting any of the electrodes when the Matthieu constants $a_q$ and $q_q$ for a quadrupole ion filter satisfy the following relationships:

$$a_q=4eU(mr_o^2\omega^2) \text{ and } q_q=2eV(mr_o^2\omega^2),$$

wherein U is a d.c. voltage; e is the ionic charge; V is the amplitude of the RF voltage applied to the electrodes; m is the ionic mass; $r_o$ is on-half the distance to any opposing poles of the quadrupole; and $\omega$ is the driving frequency of the RF voltage applied to the electrodes.

Another type of mass analyzer employing only electric fields is conventionally known as an "ion trap." Paul et al., U.S. Pat. No. 2,939,952; Cooks et al., *Chem & Eng. News.* (Mar. 25, 1991):26–41. A typical ion trap comprises three electrodes collectively having the shape that would be generated if the hyperbolic electrodes of an ideal quadrupole mass filter were rotated about an axis perpendicular to the longitudinal axis of the quadrupole (e.g., rotated about the z axis). Such rotation produces an opposing pair of hyperbolic "endcap" electrodes (i.e., the pair has a "double sheet" hyperbolic shape) with vertices oriented toward each other, and a "ring electrode" situated between the endcap electrodes. The ring electrode has a "ring donut" or "single sheet" hyperboloid shape. All three electrodes are symmetrical about the axis of rotation (z axis). The three electrodes collectively define an interior space located inside the ring electrode and between the endcap electrodes. The electrodes are energized (usually with swept RF) to create an electric field in the space.

With an ion trap, ions are either made inside the space, by injecting electrons into the space which ionize molecules present as a gas in the space, or injected into the space. Ions are typically injected into an ion trap along the axis of rotation (z axis) through an aperture in one of the endcap electrodes. The ions will possess either a stable trajectory and remain trapped in the space, or will be unstable and be lost to the electrodes. Thus, an ion trap, similar to other mass analyzers, operates on the basis of the m/z (mass/charge ratio) values of trapped ions.

The Matthieu constants for ion movement in the ion trap are as follows:

$$a_T = -16eU[(mr_o^2+2mz_o^2)\omega^2]$$

$$q_T = 8eV[mr_o^2+2mz_o^2)\omega^2].$$

Comparing the equations for $a_T$ and $q_T$ with the equations for $a_q$ and $q_q$, it can be seen that the former have an extra term $2\ mz_o^2$ that arises because ions are trapped in an ion trap by the electric field into stable repeating trajectories rather than the non-repeating trajectory of an ion through a quadrupole mass filter.

"Quistor" is an acronym for a Quadrupole Ion Store, which is essentially an ion trap tandemly coupled to a quadrupole mass filter. See, Todd, *Mass Spectrometry Reviews* 10:3–52 (1991). The ion trap serves to store ions; after a preselected delay time, a pulse is applied to one or both endcap electrodes of the ion trap to eject certain ions into the quadrupole and then to the detector. The quadrupole can be tuned to pass a specific ionic mass or a range of masses. Alternatively, the quadrupole can be scanned slowly to produce a mass spectrum.

In ion-cyclotron instruments, introduced ions are constrained to move in circular orbits by a strong, homogeneous magnetic field in a "trapped ion analyzer cell." In such a cell, an RF electrical field is applied between two parallel electrodes which are also parallel to the magnetic field. The frequency of an ion's circular motion is expressed as $w=qB/m$, wherein w is the cyclotron frequency, B is the strength of the magnetic field, and q/m is the charge-to-mass ratio of the ion. An ion is accelerated when the RF frequency matches the cyclotron frequency of the ion, which sets up a resonance condition.

In a Fourier-transform type of ion-cyclotron instrument, ions are detected by detection of the alternating image current induced between the electrodes by the coherent cyclotron motion of ions in the analyzer cell. The number of ions in the analyzer cell having a particular m/z determines the amplitude of the image current signal and the frequency of the signal is related to the m/z of the ions. Thus, for a given mixture of different ions in the analyzer cell, the amplified signal is a composite having a frequency spectrum related uniquely to the mass spectrum of the ions in the cell.

EXAMPLE 1

In this Example, we constructed an electron monochromator-mass spectrometer system utilizing an electron-monochromator as shown generally in FIG. 2. The electron monochromator was coupled to a Hewlett-Packard 5982A dodecapole mass spectrometer (Hewlett-Packard, Palo Alto, Calif.). The system was evacuated using 6-inch and 4-inch oil diffusion pumps which produced a base pressure of $1\times10^{-8}$ Torr.

The filament mounting flange of the electron monochromator was spring-mounted on three supports to a six-inch flange that included a 20-pin electrical feedthrough. The opposing end of the electron monochromator was coupled to the ion source of the mass spectrometer via two off-axis asymmetrical pins which allowed for rapid and reproducible realignment in the event the electron monochromator needed to be removed for cleaning.

All other ion-optic components and components of the mass spectrometer were as supplied by the manufacturer of the spectrometer.

The plates of the exit electrode were provided with two apertures: one on-axis and funnel shaped to pass a narrow range of electron energies as described above. The second aperture was 0.24-mm in diameter. To allow alignment of the magnetic field, the voltage to the dees is turned off and the magnets are physically moved to produce a maximum electron current at plate **18*b*** (FIG. 1). Thus, the electron monochromator produced an intense electron beam even at thermal energies.

Ions formed in the reaction chamber were urged therefrom by a small electric field (about 0.7 V/cm) and were focused onto the entrance aperture of the mass spectrometer by a six-component ion-extraction lens system. The extraction potentials were adjusted to be equal to the potential of the entrance and exit electrodes of the electron monochromator, thereby establishing a uniform potential along the path traveled by the electrons through the reaction chamber. The electron beam was undisturbed by the ion extraction optics. This was ascertained because the current measured at the electron target plate did not change when the electrodes were energized.

The ion detector comprised a Spiraltron (DeTech Model 450, Brookfield, Mass.) operated in a pulse-counting mode at 2 kV, preceded by a conversion dynode at +5 kV for anion detection an at −5 kV for cation detection. Thus, two 5-kV power supplies were required (type PMT-50A manufactured by Bertain, Hicksville, N.Y.). An electrometer (Keithley 600A, Cleveland, Ohio) was utilized to monitor the electron beam intensity at the electron target plate.

The magnetic field in the electron monochromator was produced by a pair of series-connected Helmholtz coils (Western Transformer, Portland, Oreg.) external to the monochromator housing. The Helmholtz geometry, with two parallel circular coils having a separation equal to their radius R, provided a nearly uniform axial magnetic field along the axis A (FIG. 1). The magnitude (in S.I. units) of the magnetic field along the axis A in the thin-coil limit was related to the current i by:

$$B=(4/5)^{1.5}\mu_0 Ni/R,$$

where N is the number of turns per coil and $\mu_0$ is the permeability of free space. With R=22.7 cm and N=96 turns of double-stranded #4 copper wire, the cross-section of each coil was substantially square-shaped with edge dimensions of about 4.8 cm. The thin-coil calculation was generalized by integration over the coil cross-section and yielded a calibration B/i=3.794 gauss/amp, which was in agreement with direct gaussmeter measurements.

The windings of the Helmholtz coils were constructed for continuous operation at fields to 400 gauss. Total heat dissipation in both coils was about 300 watts at the usual operating value of B=130 gauss. Since the resulting increase in temperature caused the resistance of the windings to increase, the magnetic-field power supply (Hewlett-Packard 6269B) was operated in a current-regulated mode.

Pulses from the Spiraltron detector were counted and stored in a multichannel analyzer. The data acquisition system consisted of a fast preamplifier (Ortec 9305), a main amplifier/discriminator (Ortec 9302; modified by the addition of a very fast NIM-to-TTL pulse-shape converter (Paulus Engineering Co., Knoxville, Tenn.)), a ratemeter (Ortec 9349), and a multichannel analyzer (ACE-MCS) which was housed in an IBM-XT computer with 20-MB hard drive. Data were displayed on a Princeton HX-12E monitor and printed on an IBM Proprinter II XL.

Electron energy potentials were generated by converting the channel number from the multichannel analyzer (ACE-MCS option 1) into an analogous voltage signal that was buffered and reshaped by an operational amplifier (B&B 3627) and then connected via a Wheatstone bridge to a 10-amp filament power supply (Power-ONE, Inc., Camarillo, Calif.). This arrangement allowed a linear conversion between channel number and electron energy.

Electron energy distributions were measured using several compounds with well-known electron-attachment energies. Several calibrants were used to adjust the electron monochromator/mass spectrometer system and to gain confidence in its operation. Very slow electrons (0.025 eV) were defined with sharply peaked resonances for the process $SF_6+e^-\rightarrow SF_6^{-\cdot}$ with a natural line width of 8 meV, which was well below the resolution of the instrument used in this Example. Because of memory effects from using sulfur hexafluoride, nitrobenzene and hexafluorobenzene were also used. The process $SF_6+e^-\rightarrow SF_5^-+F^\cdot$ was used to calibrate at 0.37 eV; $C_6F_6+e^-\rightarrow C_6F_5^-+\cdot$ (first resonance) was used to calibrate at 4.5 eV; and $CO+e^-\rightarrow O^-(^2P)+(^3P)$ was used to calibrate at 9.62 eV onset.

The fractional electron energy distribution, $\Delta W/W$, was approximately constant over the range of electron energies (0–10 ev) evaluated in this Example, as predicted by Stamatovic and Schulz, *Rev. Sci. Instrum.* 41:423–427 (1970). The electrostatic lens configurations used in the electron monochromator were chosen so as to give a flat transfer function over 0–10 eV. Peak centroids were used to assign the electron energy scale. Thus, the electron energies corresponded to median energies. Calibrations were performed immediately before and after data acquisition to check for possible drifts in the energy scale, which could result from contamination of the electrode surfaces by the sample. Using the deviation of the pre- and post-calibration data versus accepted resonance values, we estimated the absolute accuracy to be about ±0.07 eV at a 99% confidence level.

Figure 3:
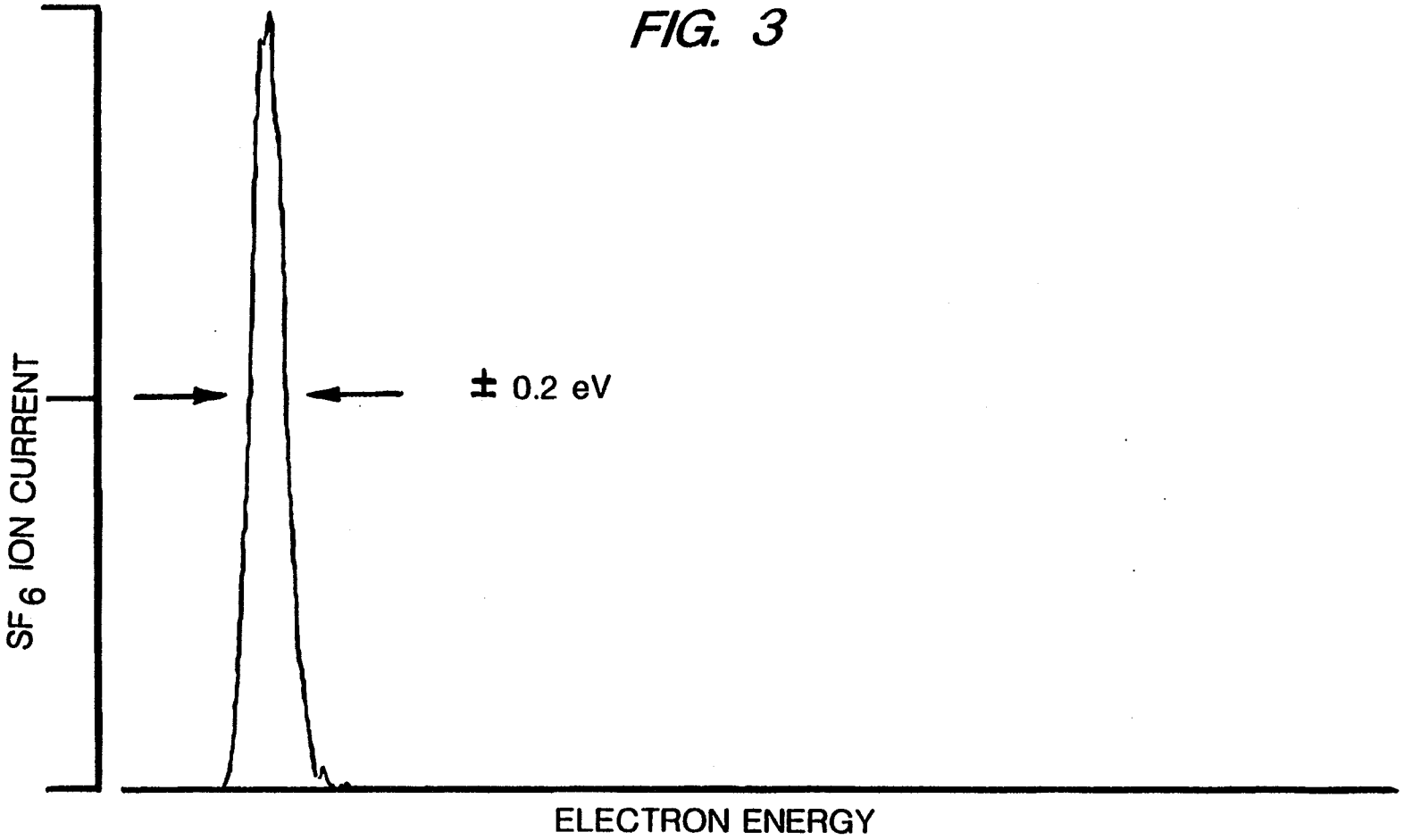
FIG. 3 is an electron-energy spectrum of $SF_6$ obtained using an electron monochromator-mass spectrometer system according to the present invention.

FIG. 3 illustrates data obtained for sulfur hexafluoride as a function of electron energy. Spectra were obtained at ±0.2 to ±0.4 eV resolution at $2\times10^{-6}$ amp measured at the target plate. The highest resolution obtained thus far has been ±0.07 eV at $5\times10^{-7}$ amp.

Measurements were made to determine the difference in ionization sensitivity for electron capture using an electron monochromator as opposed to a buffer gas to moderate electron energy. To perform these experiments, we introduced into the reaction chamber a mixture of $SF_6$ in $CH_4$ at a volume/volume ratio of 1:1100. Measurements of the $SF_6^{-\cdot}$ ion current for the process $SF_6+e^-\rightarrow SF_6^{-\cdot}$ were made at 0.03 eV electron energy at $4\times10^{-8}$ Torr. The $SF_6^{-\cdot}$ current was then measured for the processes:

$$CH_4 + e^-_{fast} \longrightarrow CH_4^{+\cdot} + e^-_{fast} + e^-_{slow}$$

$$e^-_{slow} + SF_6 \longrightarrow SF_6^{-\cdot}$$

$$SF_6^{-\cdot} + CH_4^{+\cdot} \longrightarrow SF_6 + CH_4$$

using a gas pressure of 0.2 Torr and 30 eV electrons with the same number of electrons passing through the ion source as in the first measurement. A comparison of these two measurements, after division of the $SF_6^{-\cdot}$ ion current by the gas pressure of the $SF_6/CH_4$ mixture, showed the electron monochromator to be more sensitive than the buffer-gas method by a factor of 1000 to 2000. With this substantially greater sensitivity obtained using the electron monochromator coupled to a mass analyzer, sensitive mass analysis of various compound classes is now possible, including compounds of environmental importance. Other compounds include explosives and drugs in forensic investigations, organophosphates for crop-certification programs and national defense, and alkylating agents as used in biomedical research and experimental genetics. The degree of control of ionizing electron energies that is now possible using the electron monochromator provides a foundation for two-dimensional confirmational analysis of compounds and a unique characterization profile through the appearance energies and masses of such compounds.

EXAMPLES 2–7

In these Examples, we compared ECNIMS results obtained using a Finnegan Model 4023 Mass Spectrometer operated with either a trochoidal electron monochromator (EM-MS system) to generate slow electrons or a conventional Electron-Capture Negative Ion accessory employing methane as a buffer gas to generate slow electrons (BG-MS system). Several compounds, including compounds of interest for environmental monitoring, were comparatively analyzed.

Electron energy distributions were measured using several compounds with known electron attachment energies. For example, very slow electrons having a median kinetic energy of 0.025 eV exhibited sharply peaked resonances when captured by sulfur hexafluoride ($SF_6$) to produce the molecular radical anion according to the reaction: $SF_6+e^-\rightarrow SF_6^{-\cdot}$, with a natural linewidth of 8 meV. Since sulfur hexafluoride tends to produce memory effects in conventional instruments, 0.025 eV-electrons were more often defined using nitrobenzene and hexafluorobenzene.

Calibrations were performed as follows: The reaction $SF_6+e^- \rightarrow SF_5^- + F\cdot$ was employed to calibrate at 0.37 eV; $C_6F_6+e^- \rightarrow C_6F_5^- + F\cdot$(first resonance) was employed to calibrate at 4.5 eV; and $CO+e^- \rightarrow O^-(^2P)+C\cdot(^3P)$ was employed to calibrate at 9.62 eV. Peak centroids were used to assign the electron energy scale. Thus, the energy scales reported herein corresponded to the median electron energy.

In these Examples, electrostatic lens configurations were selected to yield a flat transfer function over the energy range investigated. In the electron monochromator (EM), electrons passing through the crossed electric and magnetic fields moved trochoidally with a guiding-center velocity of $ExB/B^2$. Thus, the electron energy distribution was assumed to be constant over the range of electron energies evaluated (0–10 eV).

Electron-energy calibrations were performed immediately before and after acquiring data on test compounds. The absolute accuracy was estimated to be ±0.07 eV at the 99% confidence level. Certain compromises between energy-resolution and energy-resolved electron current were considered in order to obtain optimum results. Most spectra were obtained at 0.2 to 0.4 eV resolution at $2\times10^{-6}$ amp, as measured at the electron collector. The highest resolution obrained was ±0.07 eV at $5\times10^{-7}$ amp.

All electron-optic components were maintained at 105° C. Samples were introduced into the ion source using a 0.071×0.827-inch (OD) PYREX capillary tube on the terminus of a direct-insertion probe.

The two ionic processes that were of interest in these Examples were resonance electron capture (which forms molecular radical anions) and dissociative electron capture (which produces two fragment ions having a negative charge residing on either fragment). These processes are distinguishable by their energy requirements ($\epsilon_1$, $\epsilon_2$, and $\epsilon_3$), as shown below:

$$AB \xrightarrow[\epsilon_1]{} AB^{-\cdot}$$

$$AB \xrightarrow[\epsilon_2]{} A^- + B\cdot$$

$$AB \xrightarrow[\epsilon_3]{} A\cdot + B^-$$

Figure 4:
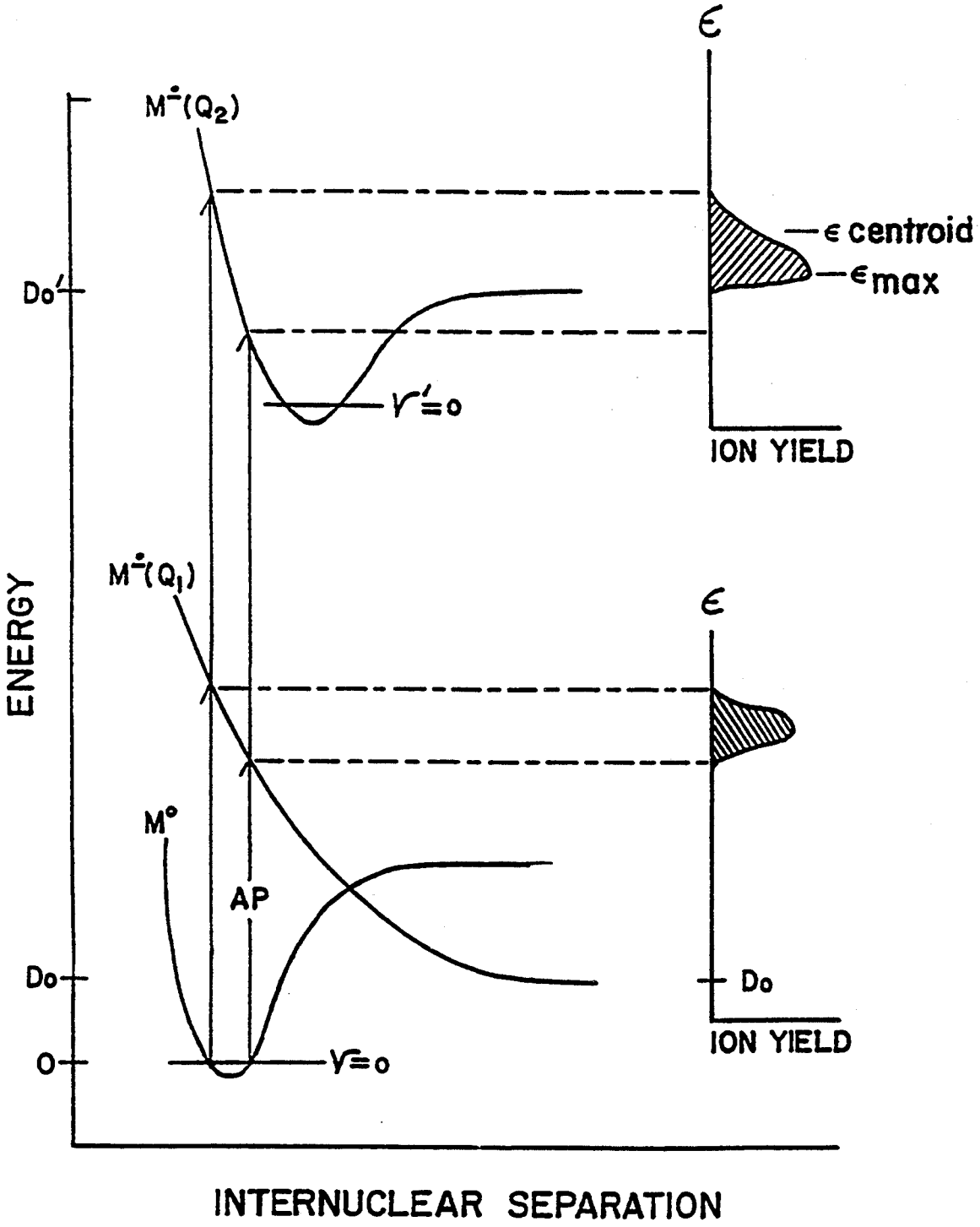
FIG. 4 shows Franck-Condon curves for electron capture with subsequent electronic dissociations.

The above processes can be described in several ways. For example, the minimum energy required for ion formation is the appearance potential (AP), or the energy associated with maximum ion production ($\epsilon_{max}$). A useful parameter for identifying peak shape is the centroid energy ($\epsilon_{centroid}$) which is defined as a median energy wherein 50% of the ion current is situated below $\epsilon_{centroid}$ and 50% is situated above $\epsilon_{centroid}$. Regardless of how a peak is described, its energetic position and shape is governed by Franck-Condon factors which, as functions of electron energy, reflect the shape of the wavefunction of the ground vibrational state in the corresponding neutral molecule. Representative Franck-Condon curves for electron capture with subsequent electronic dissociations are shown in FIG. 4, wherein the effect of observed peak shape is illustrated for a dissociation limit ($D_0'$) within the Franck-Condon envelope, and a $D_O$ value lying below the energy of the anion in the Franck-Condon region. Thus, it is possible for an observed peak to be much wider than the energy-distribution width of the electron beam since the observed peak also reflects the wavefunction of the equilibrium position of the neutral molecule.

Figure 5A:
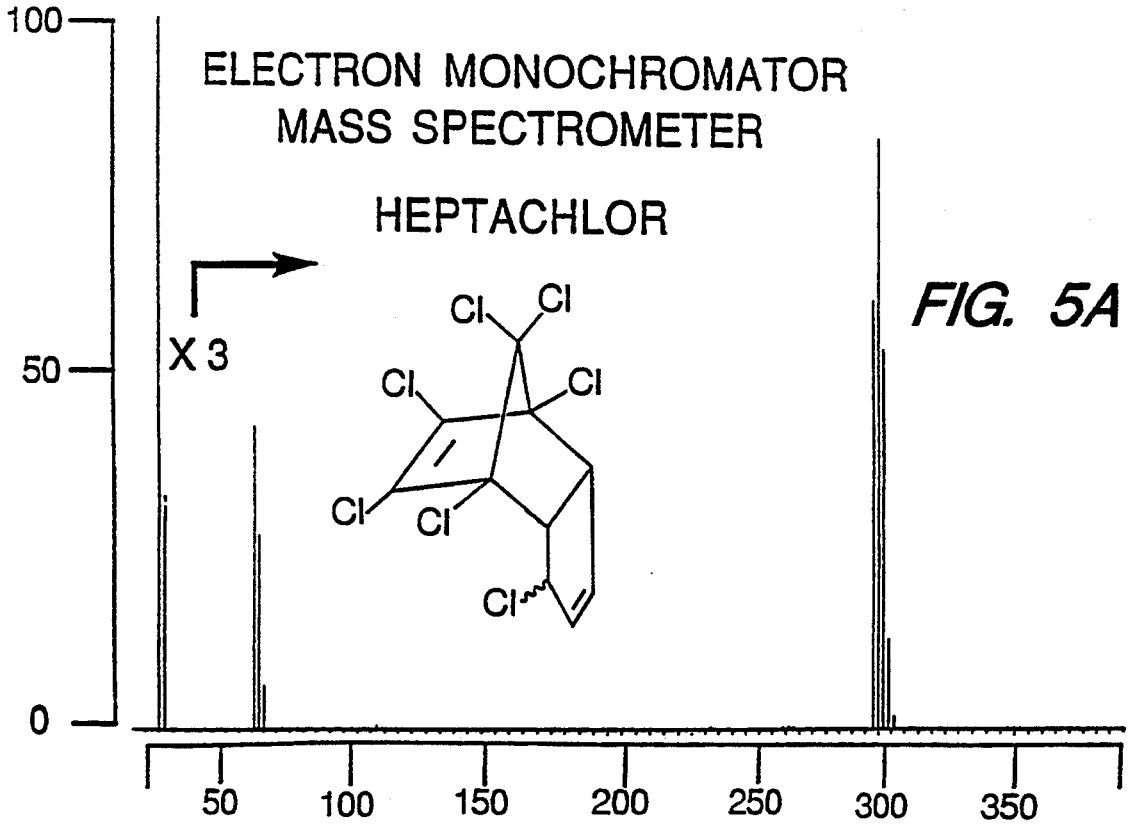
FIG. 5A shows an electron-capture negative-ion mass spectrum of the analyte heptachlor obtained using an electron monochromator-mass spectrometer system according to the present invention using electrons having a median kinetic energy of 0.3 eV.
Figure 5B:
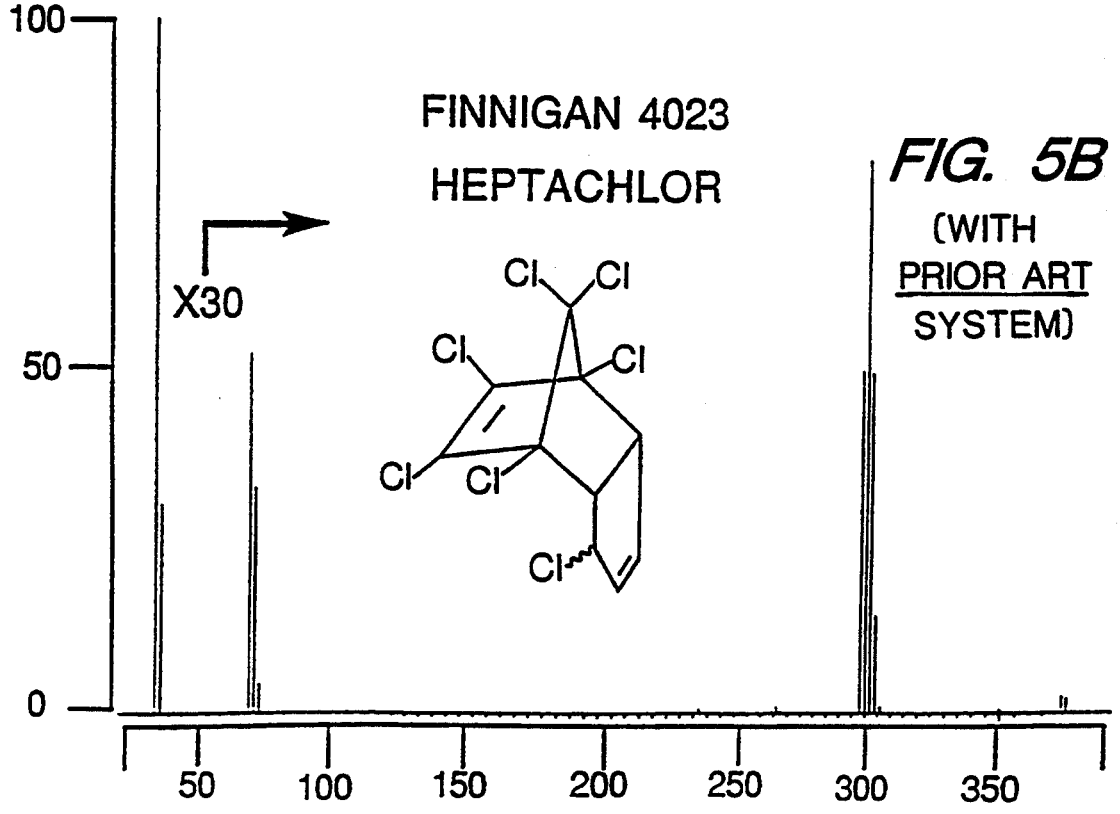
FIG. 5B is an electron-capture negative-ion mass spectrum of the analyte of FIG. 5A but obtained with a prior-art mass spectrometer without an electron monochromator and using methane as a buffer gas to produce slow electrons.

The first compound, comprising Example 2, that was comparatively analyzed was heptachlor. For EM-MS analysis, the EM was "tuned" to produce electrons having either a kinetic energy of 0.3 eV or a broad range of energies within the range 0–3 eV. The mass spectrum obtained using the EM-MS system is shown in FIG. 5A and the mass spectrum obtained using the BG-MS system is shown in FIG. 5B. As can be seen, the mass spectra obtained using both the EM-MS and the conventional BG-MS systems exhibited substantially the same ions, but the ion intensities were different. Each spectrum revealed a $(M\text{-}2HCl)^-$ peak ($m/z\approx300$), a $Cl_2^-$ peak ($m/z\approx70$), and a $Cl^-$ peak ($m/z\approx35$). A small molecular anion cluster at $m/z=370$ was observed in FIG. 5B, but not in FIG. 5A, even after scale expansion. This cluster probably represents heptachlor molecules that were stabilized by the buffer gas in the BG-MS system against autodetachment of electrons.

Figure 6:
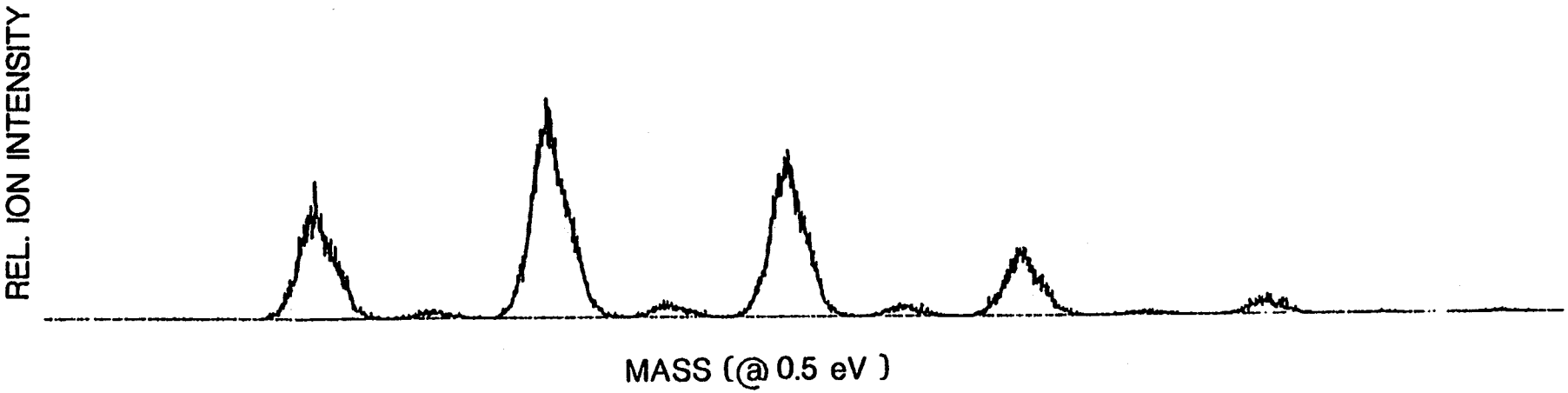
FIG. 6 is a raw-data electron-capture negative-ion mass spectrum of the molecular-ion region of hexachlorobenzene using 0.5 eV electrons and an electron monochromator-mass spectrometer according to the present invention.

In Example 3, hexachlorobenzene was evaluated using the EM-MS and BG-MS systems to evaluate the capacity of the EM-MS system to accurately reproduce isotope clusters. The raw-data mass spectrum of hexachlorobenzene using the EM-MS system at 0.5 eV electron energy is shown in FIG. 6. The spectrum revealed excellent agreement with theoretical relative probabilities of occurrences of the isotopes of this compound, wherein relative errors about each mean were ±1.4% at the 99-percent confidence level. Also, the resolution of $^{13}C$-containing ions from $^{12}C$-containing ions was excellent. Peak shape and mass resolution were also excellent.

In Example 4, we analyzed isomeric polycyclic aromatic hydrocarbons (PAHs) using the EM-MS and BG--MS systems. PAHs are difficult to distinguish by conventional mass spectrometry. Certain isomers, however, capture low-energy electrons to form stable radical anions. Such isomers typically have calculated electron affinities (EA) greater than 0.5 eV, wherein electron affinity is defined as the energy difference from the ground vibrational state of the neutral isomer to the ground vibrational state of the corresponding anion. In this Example, we investigated whether several PAHs exhibit molecular radical anions on the basis of their calculated EAs and, if so, whether the energy distributions of such anions could be used to identify the compounds.

For example, anthracene has a calculated EA of 0.49 eV. Using the EM-MS system, a molecular radical anion with $m/z=178$ was produced at energy-centroid values of 0.17±0.04 eV and 7.3±0.3 eV. The isomers pyrene and fluoroanthrene with EAs of 0.45 and 0.63 eV, respectively, exhibited a maximum $M^{-\cdot}$ production at 0.21±0.04 and 0.26±0.03 eV, respectively. In contrast, using the BG-MS system, no molecular ions were observed for anthracene or pyrene.

Figure 7A:
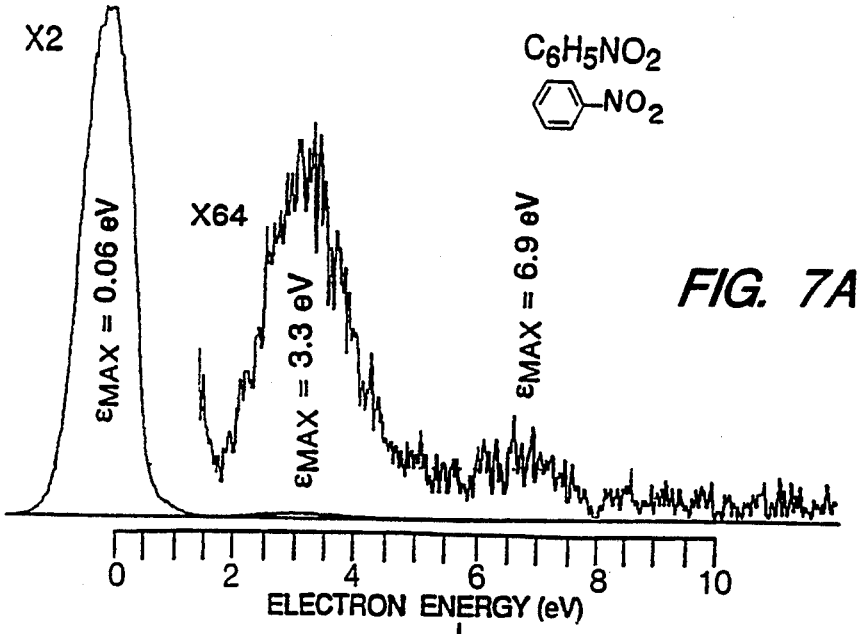
FIG. 7A shows an anion yield curve as a function of electron energy for the nitrobenzene molecular anion ($C_6H_5NO_2^{-\cdot}$), obtained using an electron monochromator-mass spectrometer according to the present invention.
Figure 7B:
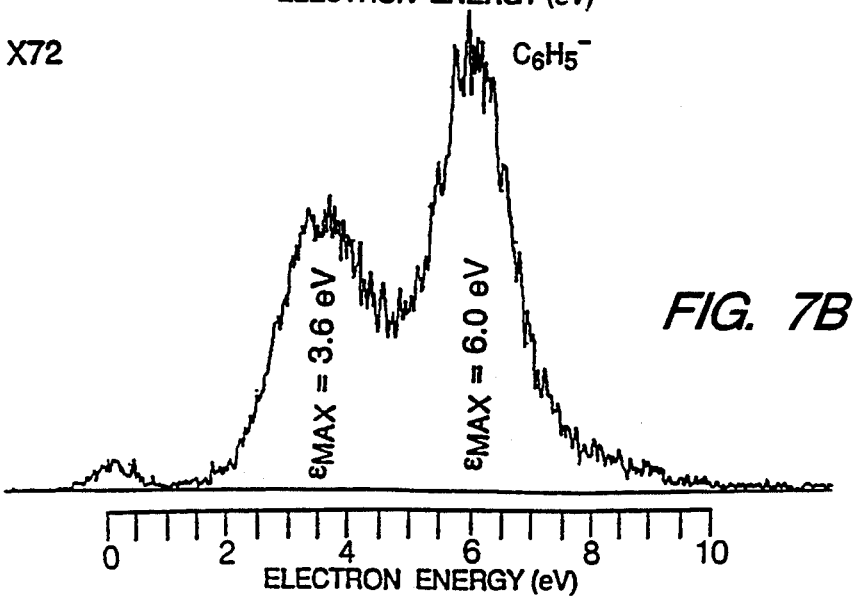
FIG. 7B shows an anion yield curve as a function of electron energy for the $C_6H_5^-$ fragment anion from nitrobenzene, obtained using an electron monochromator-mass spectrometer according to the present invention.
Figure 7C:
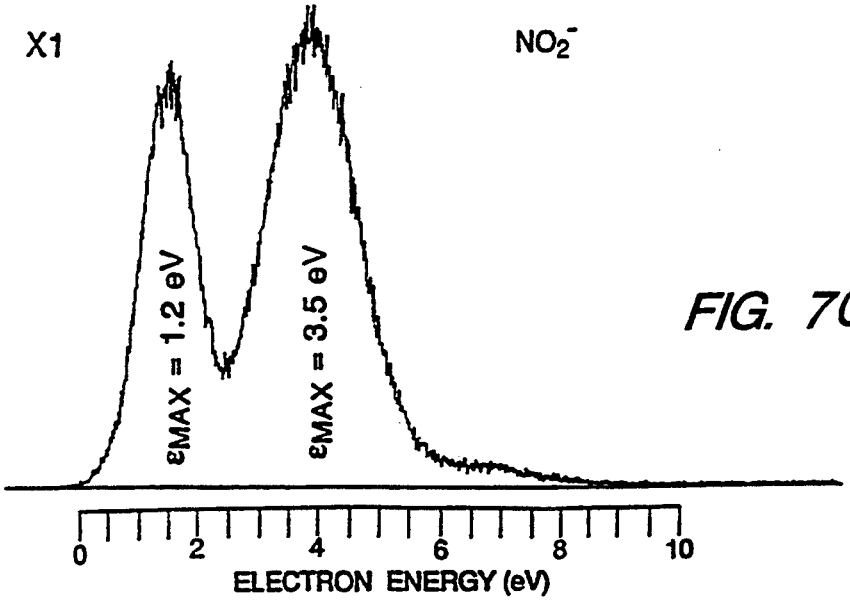
FIG. 7C shows an anion yield curve as a function of electron energy for the $NO_2^-$ fragment anion from nitrobenzene, obtained using an electron monochromator-mass spectrometer according to the present invention.

Referring to FIGS. 7A–7C, nitrobenzene, which has a high EA (about 1.0 eV), exhibited three negative ion resonance states for the molecular radical anion ($C_6H_5NO_2^{-\cdot}$) with $m/z=123$ (FIG. 7A), three states for the phenyl ion ($C_6H_5^-$) with $m/z=77$ (FIG. 7B), and two states for the $NO_2^-$ ion with $m/z=46$ (FIG. 7C), when analyzed using the EM-MS system. In FIG. 7A, the molecular radical anion showed maximum production at energies of 0.06 eV, 3.3 eV, and 6.9 eV, which are in reasonable agreement with published figures. Jäger et al., *Z. Naturforsch.* 22a:700 (1967). The first and second resonances were assumed to be $\pi^*$ states and the third resonance a $\sigma^*$ state (because of its relatively high energy). In FIG. 7B, the maximal amount of phenyl anion was produced at energies of 3.56 eV and 6.02 eV and a small contribution of a resonance near zero, whereas the nitro ($NO_2^-$) anion appeared at 1.2 eV and 3.53 eV (FIG. 7C). These electron energies for the production of the nitro anion agree with published values. Christophorou et al., *J. Chem. Phys.* 45:536–547 (1966).

In Example 5, we obtained and evaluated mass spectra of several s-triazine herbicides. These herbicides represented a class of compounds with a large number of derivatives whose ECNI spectra obtained using conventional ECNIMS instruments are especially complex. That is, the ECNI spectra (produced using the BG-MS system) of s-triazine herbicides using methane as a buffer gas exhibit numerous adduct ions each having a significant intensity.

For example, referring to FIG. 8, atrazine produced abundant $(M+1)^-$ions as well as $(M+2)^-$, $(M+14)^-$, $(M+28)^-$, $(M+Cl)^-$ ions, and fragment ions when analyzed using the conventional BG-MS system. Similar ions were observed for other 2-chloro-s-triazines (data not shown). Ametryne, a 2-alkylthio-s-triazine, produced $(M+1)^-$, $(M+13)^-$, and $(m+25)^-$ ions when analyzed using the conventional BG-MS system (data not shown). These various artifact ions were not observed in the spectra of atrazine and ametryne obtained using the EM-MS system.

Despite their relative simplicity, the energy spectra of the s-triazine herbicides obtained using the EM-MS system revealed substantial amounts of information. For example, referring to FIG. 9A, when atrazine was exposed to 1.81 eV electrons, peaks corresponding to $(M-H)^-$ with $m/z=214$, to $(M-HCl)^-$ with $m/z=179$, and to $Cl^-$ with $m/z=35$ were produced. As shown in Table I, these peaks had only one resonance state each. Ametryne also produced these fragment ions, but from several resonance states, as shown in Table I.

Scale expansions were necessary to visualize the $(M-H)^-$ and $(M-HCl)^-$ peaks.

Figure 10:
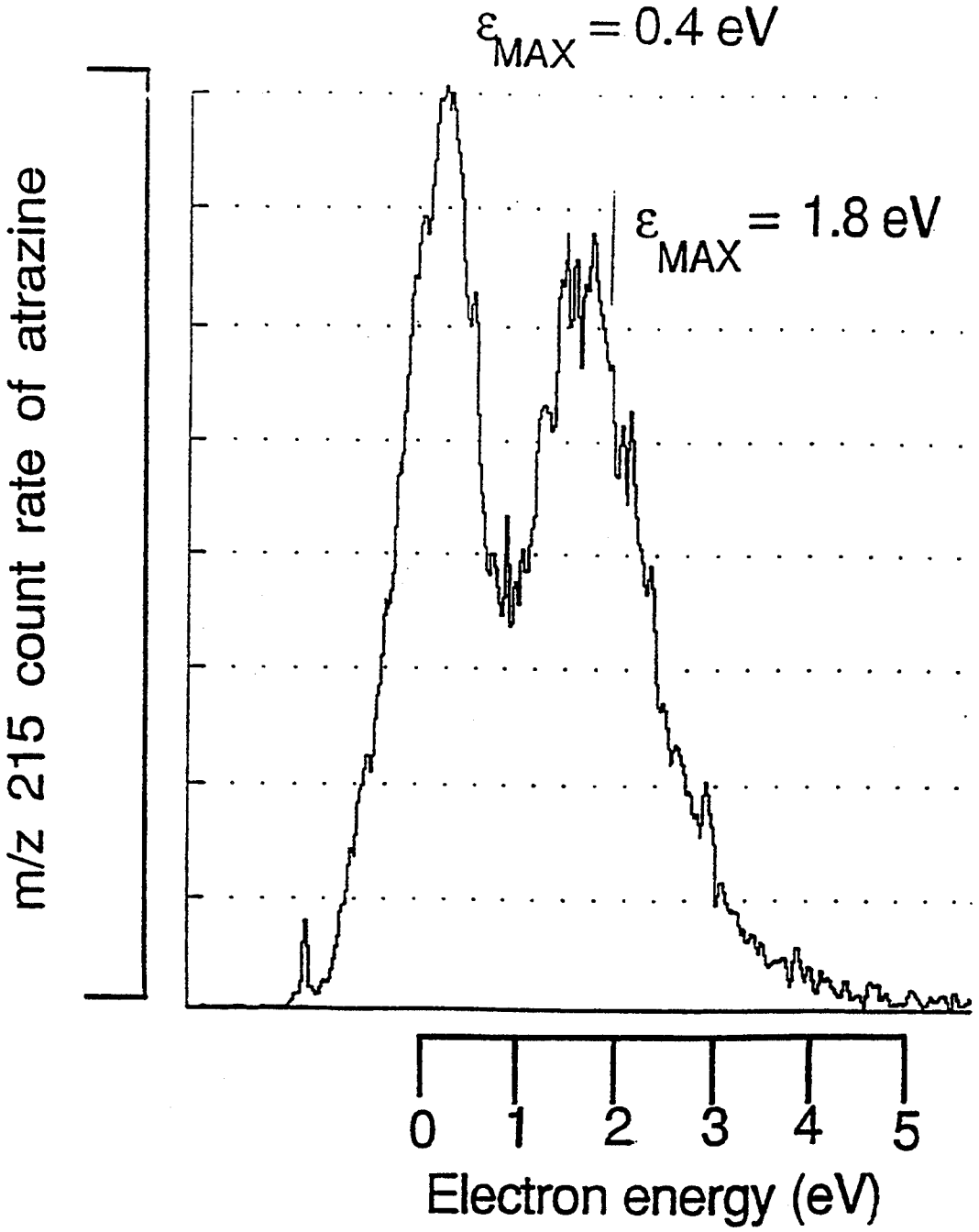
FIG. 10 shows the separation of $M^{-\cdot}$ from $^{13}C-(M-H)^-$ on the basis of their molecular orbital energy differences for $m/z=215$ of atrazine using an electron monochromator-mass spectrometer according to the present invention, wherein $M^{-\cdot}$ and $^{13}C-(M-H)^-$ differ in mass by only 0.0045 daltons.

In Example 6, atrazine was analyzed with the EM-MS system adjusted to transmit $m/z=215$, which is known to consist of $M^{-\cdot}$ and $(M-H)^-$ species. Huang et al., *Biomed. Environ. Mass Spectrom.* 18:828–835 (1989). The electron energy was scanned. As shown in FIG. 10, two peaks in the energy-resolved spectrum were found with $\epsilon_{max}$ values of about 0.4 eV and 1.8 eV. The 1.8-eV value agreed with the $\epsilon_{max}$ value for $(M-H)^-$ production within an experimental error of $\pm 0.07$ eV. The 0.4-eV value was the result of $M^{-\cdot}$ production.

Using conventional mass spectrometry, the mass resolution required for separation of $M^{-\cdot}$ from $(M-H)^-$ with one C-13 is 48,000. In contrast, as shown in FIG. 10, the same separation on an electronic-energy basis using an EM-MS system according to the present invention is achievable with a resolution of only about 50. Thus, the EM provides an advantage by using electron energy rather than mass as the basis of the separation and identification of a sample compound.

In Example 7, we analyzed polychlorodibenzo-p-dioxins, which are uniquely suited for analysis by ECNIMS. These compounds absorb electrons and yield molecular radical anions if the electron affinities are sufficiently high. More highly chlorinated dioxins produce $M^{-\cdot}$, and the lower chlorinated compounds produce $(M-H)^-$.

EXAMPLE 8

In this Example, we constructed an instrument capable of scanning both the electron energy and ion mass. This was done by imposing a magnetic field onto an ion trap, Thompson, *New Scientist* Sep. 3, 1987, pp. 56–59, and trapping simultaneously all ions produced. The frequencies of the oscillating ions in the trap were deconvoluted to yield the mass of the ions by Fourier transform. Marshall et al., *J. Chem. Phys.* 71:4434–4444 (1979).

Candidate ion traps for this purpose include, but are not limited to, the Penning trap in which a battery of just a few volts is connected to the trap so that the end caps are negative and the ring electrode is positive.

TABLE I

| S-triazine Herbicide | Electron-energy Centroids (eV) | | | | | | |
|---|---|---|---|---|---|---|---|
| | $M^{-\cdot}$ | $(M-H)^-$ | $(M-HCl)^{-\cdot}$ | $Cl^-$ | $(M-CH_3)^-$ | $(M-SCH_3)^-$ | $(M-HSCH_3)^-$ |
| Atrazine | 0.21 | 1.97 | 0.97 | 0.95 | | | |
| | 1.98 | | | | | | |
| Ametryne | 0.30 | 0.35 | | | 1.15 | 0 | 4.75 |
| | 2.07 | 2.05 | | | 5.00 | 4.82 | |
| | | 5.63 | | | 7.22 | | |
| | | 9.20 | | | | | |

Other 2-chloro-s-triazines and 2-alkylthio-s-triazines showed similar spectral behavior with respect to single versus multiple resonance states when analyzed using the EM-MS system (data not shown).

Figure 9A:
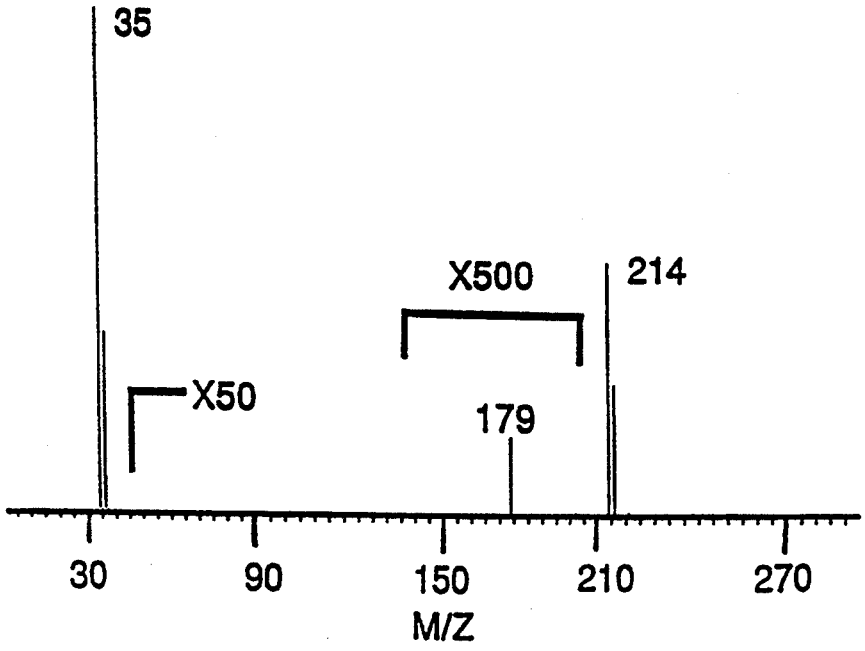
FIG. 9A shows an anion yield curve for $(M-H)^-$ from atrazine obtained with an electron monochromator-mass spectrometer according to the present invention at a peak electron energy of 1.8 eV.
Figure 9B:
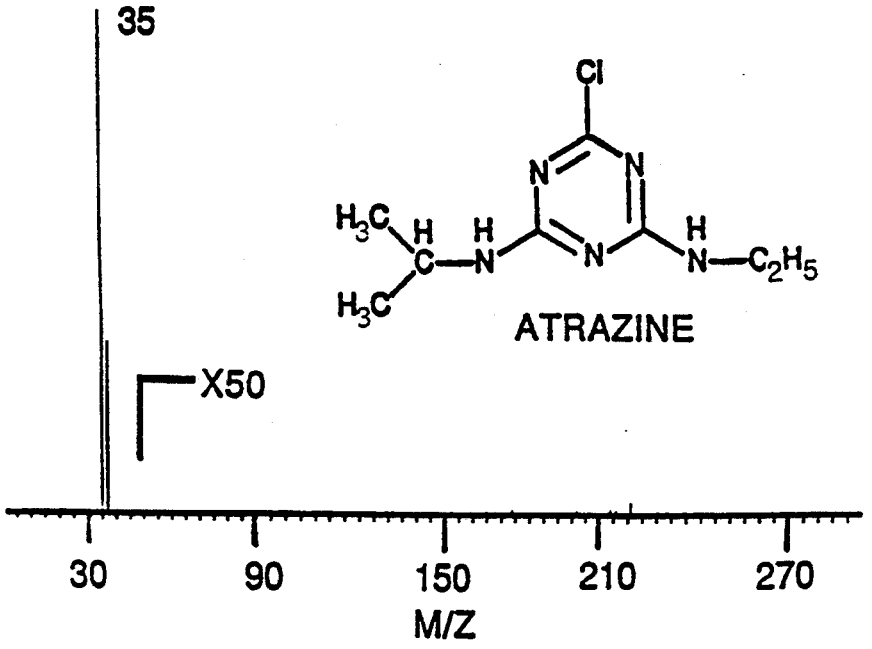
FIG. 9B shows an anion yield curve for $Cl^-$ from atrazine obtained with an electron monochromator-mass spectrometer according to the present invention at a peak electron energy of 0.03 eV.

As shown in FIG. 9B, when the EM was adjusted to produce 0.03-eV monochromatic electrons (the appearance energy for production of the chloride ion), no other ions with any intensity appeared in the atrazine spectrum. When the EM was adjusted to produce 1.81-eV electrons, which is the electron energy required for maximum production of $(M-H)^-$, the chloride peak was still the most intense in the spectrum (FIG. 9A).

Penning, *Physica* 9:873–894 (1936). In a Penning trap, anions undergo a stable oscillations in the z-dimension, i.e., coaxial with the end caps, With frequency $\omega_z^2=2eV/mr_0^2$. Dehmelt, *Angew. Chem. Int. Ed. Engl.* 29:734–738 (1990). A magnetic field is applied in the axial direction to prevent anions from moving toward the ring electrode and confine the electrons in an orbit in the plane of the ring with a rotational frequency that is slightly smaller than the undisturbed cyclotron frequency, $\omega_c=zeB/2\pi m$. Paul, *Rev. Mod. Phys.* 62:531–540 (1990); Paul, *Angew. Chem. Int. Ed. Engl.* 29:739–748 (1990).

Another suitable type of ion trap is the well-known commercially available RF trap. Cooks et al., *Acc. Chem. Res.* 23:213–219 (1990).

Ions were formed by a ramped electron beam which was stored inside the trap. Image currents, Sirkis et al., *Am. J. Phys.* 34:943–946 (1966), were detected by Fourier transform. A broad-band bridge detector was used to detect the image currents, which allowed a mass spectrum to be acquired quickly at constant magnetic field strength. Fourier transform pulse sequences, Cody et al., *Anal. Chem.* 54:96–101 (1982); Parisod et al., *Adv. Mass Spectrom.* 8:212–223 (1980); Ghaderi et al., *Anal. Chem.* 53:428–437 (1981), utilized an RF chirp (usually 0–1 MHz in 1 ms) to accelerate all the ions coherently so that their frequencies could be measured. The free-induction decay transient signal was amplified, digitized, and recorded using a transient recorder. Fourier transforms were performed using computer software designed for this purpose that performed forward and reverse computations on arrays up to 512 kbytes of RAM.

Electron energy scanning revealed energy maxima for production of molecular ions from isomeric 1,2,3,4-TCDD and 1,3,6,8-TCDD of 0.23 and 0.38 eV, respectively, as shown in Table II. These electron attachment energies follow the same ordering as their calculated lowest unoccupied orbital energies of 0.96 and 1.59 eV, respectively. The 1,2,3,4-TCDD isomer produced chloride ion from two states at 0.78 and 3.75 eV and lost a chlorine atom at 0.43 eV. The 1,3,6,8-TCDD isomer, in contrast, produced a chlorine atom and a chloride at virtually identical energies (Table II).

TABLE II

| Compound | $M^{-\cdot}$ | $Cl^-$ | $(M—Cl)^-$ |
|---|---|---|---|
| 1,2,3,4-TCDD | 0.23 eV | 0.78 eV<br>3.75 eV | 0.43 eV |
| 1,3,6,8-TCDD | 0.38 eV | 0.66 eV<br>3.81 eV | 0.64 eV<br>3.81 eV |

Thus, using an electron monochromator as a source of electrons for producing ions for mass analysis offers the following advantages: (a) The need to use a buffer gas to generate slow electrons for NIMS is eliminated, which helps to remedy certain spontaneous and undesirable ion/molecule reactions between the sample ions, and ions or molecules of the buffer gas. (b) Elimination of ion-molecule reactions by elimination of buffer gas means that the ion source remains cleaner for longer periods of time. In fact, our ion source is cleaned once a year compared to about once a week when using a buffer gas. (c) Ion-current loss by charge neutralization of positive and negative ions is also eliminated since the electron energy can be set below the ionization potential of any other compound in the ion source, including the analyte of interest. (d) Using an electron monochromator allows isomers to be resolved on the basis of electron energies rather than mass difference of ionic products, thereby allowing smaller, less bulky equipment to be used to achieve equivalent or superior resolving power over conventional mass spectrometry methods.

Stabilization of radical anions to prevent autodetachment is an important function of the buffer gas in conventional NIMS. Hence, generating anions using an electron monochromator, according to the present invention, rather than a buffer gas may allow some autodetachment to occur, with a consequent reduction in sensitivity. However, any such sensitivity reduction would be small relative to the dramatic increase in resolving power possible according to the present invention.

The foregoing examples indicate that a wide variety of measurements, heretofore impossible, are now possible according to the present invention. These include: detection of controlled detoxification events by microbial degradation of halogenated chemical pollutants such as polychlorodibenzodioxins, polychlorodibenzofurans, polychlorobiphenyls, polybrominated compounds and others; reductive photochemical degradation studies of various environmental chemicals, in determinations of negative ion appearance energies for positional isomers, and negative ion resonance states populated by ionizing electrons; in regulating regiospecific halide ion ejection from polyhalogenated compounds; and in differentiating explosives by energy profiling. Coupling of the electron monochromator to any of various mass analyzers provides a new dimension for the analysis of electronegative and other compounds in many different matrices and under a variety of circumstances.

In addition, since ions of particular analytes are generated at specific electronic energies, as shown hereinabove, it is now possible according to the present invention to discriminate between positional isomers of a given analyte. For example, as described above, the unique energetic positions and shapes of the ion-yield curves for isomeric polyaromatic hydrocarbons, polychlorinated dibenzo-p-dioxins, dibenzofurans, and other halogenated environmental chemicals is useful for environmental monitoring using methods and apparatuses according to the present invention, particularly when analytical standards for the compounds of interest are not available.

Coupling an electron monochromator to a mass analyzer according to the present invention also permits substantial improvements in positive-ion mass analysis and allows, for the first time, certain analyses to be made. For example, there has been a long-felt but unmet need in the petroleum industry for methods and apparatuses for analyzing petroleum samples to determine the relative amounts of aromatics and aliphatics. The ionization energies of aromatics are in the range of 7–8 eV while the ionization energies of aliphatics are in the range of 10–11 eV. It is appreciated by skilled practitioners that mass spectrometry is an important technique for assaying organic mixtures. However, the typical range of electron energies produced by the filament in a conventional mass analyzer is too broad, even with tuning of the filament potential, to selectively ionize aromatics without also ionizing aliphatics, particularly while still maintaining adequate intensity. A combination of the electron monochromator and a mass analyzer, in contrast, allows the energy bandwidth of the electron beam impinging the sample to be narrowed to a small fraction of an electron volt while still maintaining beam intensity. Thus, a complex organic mixture, such as petroleum can be assayed for aromatics without ionizing any aliphatics, thereby yielding much cleaner results.

While the invention has been described in connection with preferred embodiments and multiple examples, it will be understood that it is not limited to such embodiments and examples. On the contrary, it is intended to cover all alternatives, modifications, and equivalents as may be included within the spirit and scope of the invention as defined by the appended claims.

We claim:

1. A method for analyzing a sample material for the presence of molecules of an analyte in the sample material, the method comprising:
   (a) generating monochromatic electrons having a kinetic energy within a range of greater than zero to less than about 6 eV;
   (b) contacting molecules of the sample with the monochromatic electrons to form negative ions from at least a subpopulation of the molecules; and
   (c) mass-analyzing the ions formed in step (b) to determine whether the ions formed in step (b) included ions of the analyte.

2. A method as recited in claim 1 wherein the analyte has a resonant electron-capture energy and step (a) comprises generating monochromatic electrons having a kinetic energy substantially equal to the resonant electron-capture energy.

3. A method as recited in claim 2 wherein step (c) comprises mass-analyzing negative ions formed in step (b).

4. A method as recited in claim 2 wherein the monochromatic electrons have a kinetic energy of no greater than about 5 eV.

5. A method as recited in claim 1 wherein the analyte has an ionization energy and step (a) comprises generating monochromatic electrons having a kinetic energy substantially equal to the ionization energy.

6. A method as recited in claim 5 wherein step (c) comprises mass-analyzing positive ions formed in step (b).

7. A method as recited in claim 1 wherein step (c) comprises passing the ions formed in step (b) through a mass spectrometer.

8. A method for analyzing a sample material to determine whether or not molecules of an analyte are present in the samplel material, the method comprising:
   (a) generating monochromatic delectrons having a kinetic energy suitable for the electrons having a kinetic energy suitable for the electrons to be captured by molecules of the analyte;
   (b) contacting molecules of the sample material with the monochromatic electrons to form anions; and
   (c) passing the anions through a mass analyzer to ascertain whether or not the anions include anions of the analyte.

9. A method as recited in claim 8 wherein the monochromatic electrons produced in step (a) have a kinetic energy of greater than zero to less than about 6 eV.

10. A method for analyzing a sample to determine whether molecules of an analyte are present in the sample, the method comprising:
   (a) generating a beam of electrons;
   (b) passing the beam of electrons into crossed magnetic and electrical fields to cause the beam to divergently spread as the beam passes through the crossed magnetic and electrical fields, wherein electrons of the beam having a desired kinetic energy experience a degree of divergence that is different from degrees of divergence experienced by electrons of the beam having other kinetic energies;
   (c) allowing electrons having the desired kinetic energy to exit as a monochromatic beam having the desired kinetic energy within a range of greater than zero to less than about 6 eV from the crossed magnetic and electric fields;
   (d) contacting molecules of the sample with the monochromatic beam to form anions of said molecules; and
   (e) passing the anions through a mass analyzer to produce a mass spectrum of the sample revealing whether or not ions of the analyte were formed.

11. A method as recited in claim 10 wherein step (a) comprises generating an electron beam in which the electrons have a kinetic energy suitable for forming molecular anions of the analyte by electron capture.

12. A method as recited in claim 10 including the step, after step (c) but before step (d), of collimating the monochromatic beam.

13. A method as recited in claim 10 including the step, after step (a) but before step (b), of magnetically confining the electron beam.

14. A method as recited in claim 13 including the step, after step (c) but before step (d), of collimating the monochromatic beam.

15. A method as recited in claim 11 wherein the desired kinetic energy of the monochromatic beam in step (c) is within a range of greater than zero to about 5 eV.

16. A method for mass analyzing a sample to ascertain whether or not the sample contains molecules of an analyte of interest, the method comprising:
   (a) generating monochromatic electrons having a kinetic energy level at which the electrons are absorbable by molecules of the analyte to form molecular anions of the analyte;
   (b) contacting molecules of the sample analyte with the monochromatic electrons to form anions; and
   (c) passing the anions into a mass analyzer to produce a mass spectrum of the analyte revealing whether or not stable molecular anions of the analyte were formed.

17. A method as recited in claim 16 wherein the monochromatic electrons are generated using an electron monochromator.

18. A method as recited in claim 16 wherein the monochromatic electrons have a kinetic energy level of no greater than about 6 eV.

19. A method as recited in claim 18 wherein the kinetic energy level of the monochromatic electrons is no greater than about 5 eV.

20. A method for performing electron-capture negative-ion mass spectrometry of a sample material to determine whether the sample material comprises molecules of an analyte, the method comprising:
   (a) passing a beam of electrons through an electron monochromator to produce a monochromatic beam of electrons having a kinetic energy suitable for the electrons to be captured by molecules of the analyte to form anions of the analyte;
   (b) contacting molecules of the sample material with the monochromatic electrons to form anions; and
   (c) passing the anions through a mass analyzer to produce a mass spectrum of the sample material.

21. A method as recited in claim 20 wherein, in step (a), the monochromatic electrons have a kinetic energy within a range of greater than zero to about 6 eV.

22. An apparatus for performing electron-capture negative ion mass-spectrometry, comprising:
   (a) a mass analyzer capable of mass analyzing anions; and
   (b) an electron manochromator coupled to the mass analyzer, the electron monochromator being adjustable to produce a monochromatic beam of electrons having a kinetic energy within a range of greater than zero to less than about 6 eV.

23. An apparatus as recited in claim 22 wherein the mass analyzer comprises an ion trap.

24. An apparatus as recited in claim 22 wherein the mass analyzer comprises a high-resolution mass spectrometer.

25. An apparatus as recited in claim 22 wherein the mass analyzer comprises a quistor.

26. An apparatus as recited in claim 22 wherein the mass analyzer comprises an ion-cyclotron.

* * * * *

UNITED STATES PATENT AND TRADEMARK OFFICE

CERTIFICATE OF CORRECTION

PATENT NO. : 5,340,983

DATED : August 23, 1994

INVENTOR(S) : DEINZER ET AL.

It is certified that error appears in the above-indentified patent and that said Letters Patent is hereby corrected as shown below:

On the Title page, References Cited, U.S. Patent Documents:

The issue date for U.S. Patent No. 4,933,551 to Bernius et al. should be --6/1990--.

Column 3, line 18, "$Bu^{+\cdot}+M^{-\cdot}\rightarrow Bu+M$" should be --$Bu^{+\cdot} + M^{-\cdot} \longrightarrow Bu + M$--.

Claim 8, column 23, line 40, "samplel" should be --sample--.

Claim 8, column 23, line 41, "delectrons" should be --electrons--.

Claim 8, column 23, lines 42-43, the second occurrence of the words "having a kinetic energy suitable for the electrons" should be deleted.

Claim 22, column 24, line 67, "manochromator" should be --monochromator--.

Signed and Sealed this

Twentieth Day of February, 1996

*Attest:*

*Attesting Officer*

BRUCE LEHMAN

*Commissioner of Patents and Trademarks*